US011427429B2

(12) United States Patent
Shiobara et al.

(10) Patent No.: US 11,427,429 B2
(45) Date of Patent: Aug. 30, 2022

(54) STACKER AND MEDIUM PROCESSING DEVICE

(71) Applicant: SEIKO EPSON CORPORATION, Tokyo (JP)

(72) Inventors: Hiroshi Shiobara, Matsumoto (JP); Akinobu Nakahata, Shiojiri (JP); Tsuyoshi Furumido, Shiojiri (JP); Kohei Ueno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/579,084

(22) Filed: Sep. 23, 2019

(65) Prior Publication Data

US 2020/0095085 A1 Mar. 26, 2020

(30) Foreign Application Priority Data

Sep. 26, 2018 (JP) ..... JP2018-179826

(51) Int. Cl.

| | |
|---|---|
| ***B65H 31/26*** | (2006.01) |
| ***B65H 31/36*** | (2006.01) |
| ***B65H 43/06*** | (2006.01) |
| ***B65H 29/38*** | (2006.01) |
| ***B65H 29/22*** | (2006.01) |
| ***B65H 31/30*** | (2006.01) |
| ***B65H 31/34*** | (2006.01) |

(52) U.S. Cl.

CPC ..... *B65H 43/06* (2013.01); *B65H 29/22* (2013.01); *B65H 29/38* (2013.01); *B65H 31/26* (2013.01); *B65H 31/3081* (2013.01); *B65H 31/34* (2013.01)

(58) Field of Classification Search

CPC ..... B65H 31/36; B65H 31/02; B65H 31/26; B65H 31/3081; B65H 2404/1114; B65H 29/38; B65H 29/22; B65H 2301/4223; B65H 2301/4222; B65H 31/34; B65H 43/06

See application file for complete search history.

(56) References Cited

U.S. PATENT DOCUMENTS

| | | | |
|---|---|---|---|
| 6,220,592 | B1 | 4/2001 | Watanabe et al. |
| 7,690,637 | B2 | 4/2010 | Yamamoto |

(Continued)

FOREIGN PATENT DOCUMENTS

| | | |
|---|---|---|
| CN | 101234714 | 8/2008 |
| JP | H06-127794 A | 5/1994 |

(Continued)

*Primary Examiner* — Luis A Gonzalez

(74) *Attorney, Agent, or Firm* — Workman Nydegger

(57) ABSTRACT

A stacker includes a medium stacking portion for receiving and stacking a medium processed and discharged by a processing unit, a medium butting portion for aligning the medium by contacting a leading end of the medium, and a paddle that includes a feeding portion and is for transporting the medium received by the medium stacking portion in a direction toward the medium butting portion by rotating. Furthermore, the stacker has a first mode in which the paddle stops in a state in which the feeding portion does not contact the medium on the medium stacking portion and a second mode in which the paddle stops in a state in which the feeding portion comes into contact with the medium on the medium stacking portion and is deformed.

9 Claims, 15 Drawing Sheets

(56) References Cited

U.S. PATENT DOCUMENTS

| | | | | |
|---|---|---|---|---|
| 2007/0145674 | A1 | 6/2007 | Saito | |
| 2008/0185773 | A1 | 8/2008 | Yamamoto | |
| 2017/0233214 | A1* | 8/2017 | Kim | B65H 31/36 270/1.01 |
| 2017/0322508 | A1 | 11/2017 | Taki | |
| 2018/0050536 | A1* | 2/2018 | Muro | B41J 2/04586 |
| 2018/0181050 | A1* | 6/2018 | Kawaguchi | B65H 31/26 |

FOREIGN PATENT DOCUMENTS

| | | | | |
|---|---|---|---|---|
| JP | H11-301912 | A | | 11/1999 |
| JP | H11-322162 | A | | 11/1999 |
| JP | 2000-247529 | A | | 9/2000 |
| JP | 2007022799 | A | * | 2/2007 |
| JP | 2009-035371 | A | | 2/2009 |
| JP | 2013-079122 | | | 5/2013 |
| JP | 2013-095533 | | | 5/2013 |
| JP | 2017-200849 | | | 11/2017 |

* cited by examiner

STACKER AND MEDIUM PROCESSING DEVICE

The present application is based on, and claims priority from JP Application Serial Number 2018-179826, filed Sep. 26, 2018, the disclosure of which is hereby incorporated by reference herein in its entirety.

BACKGROUND

1. Technical Field

The present disclosure relates to a stacker on which a medium is stacked, and a medium processing device provided with a transport mechanism for transporting the media to the stacker.

2. Related Art

As an example of this type of medium processing device, for example, in JP-A-2000-247529, there is disclosed a sheet discharge processing device which accommodates a medium such as a discharged sheet in a tray which is an example of a medium stacking portion and which always accommodates the medium at a predetermined position on the tray. The sheet discharge processing device includes a paddle mechanism having a paddle portion disposed between a sheet discharge portion and the tray and whose end is rotatably supported by a support shaft, and a paddle drive mechanism for positioning the paddle portion at least at a pushing position where the paddle portion stands upright in front of the sheet discharge portion and a pressing position where the uppermost surface of the media accommodated in the tray is pressed.

SUMMARY

However, in the medium processing device described in JP-A-2000-247529, since a flat portion of the paddle portion only rests on the medium on a medium placing portion, the force to press the medium is weak, and the discharged medium may come in contact to cause misalignment.

According to an aspect of the present disclosure, a stacker includes a medium stacking portion receiving and stacking a medium processed and discharged by a processing unit, a medium butting portion aligning the medium by contacting the leading end of the medium, a feeding portion, and paddle transporting the medium received by the medium stacking portion in a direction of the medium butting portion by rotating, having a first mode in which the paddle stops in a state in which the feeding portion does not contact the medium on the medium stacking portion, and a second mode in which the paddle stops in a state in which the feeding portion comes into contact with the medium on the medium stacking portion and is deformed.

According to still another aspect of the present disclosure, a stacker includes a medium stacking portion receiving and stacking a medium transported in a second transport direction which is a direction opposite to a first transport direction after being transported in the first transport direction, a medium butting portion aligning the medium by contacting a leading end of the medium, and a paddle including a feeding portion and being for transporting the medium received by the medium stacking portion toward the medium butting portion by rotating, and has a first mode in which the paddle stops in a state in which the feeding portion does not contact the medium on the medium stacking portion, and a second mode in which the paddle stops in a state in which the feeding portion comes into contact with the medium on the medium stacking portion and is deformed.

According to still another aspect of the present disclosure, a medium processing device includes the stacker and a transport mechanism transporting the medium and discharging the medium to the stacker, or transporting the medium in a first transport direction and a second transport direction opposite to the first transport direction and discharging the medium to the stacker.

DESCRIPTION OF EXEMPLARY EMBODIMENTS

Hereinafter, a medium processing system including a medium processing device according to an embodiment will be described with reference to drawings. The medium processing system discharges ink, which is an example of liquid, onto a medium such as paper, for example, to perform printing processing for printing characters and images as processing for the medium and predetermined post-processing on a stacked media group by stacking a plurality of printed media.

Figure 1:
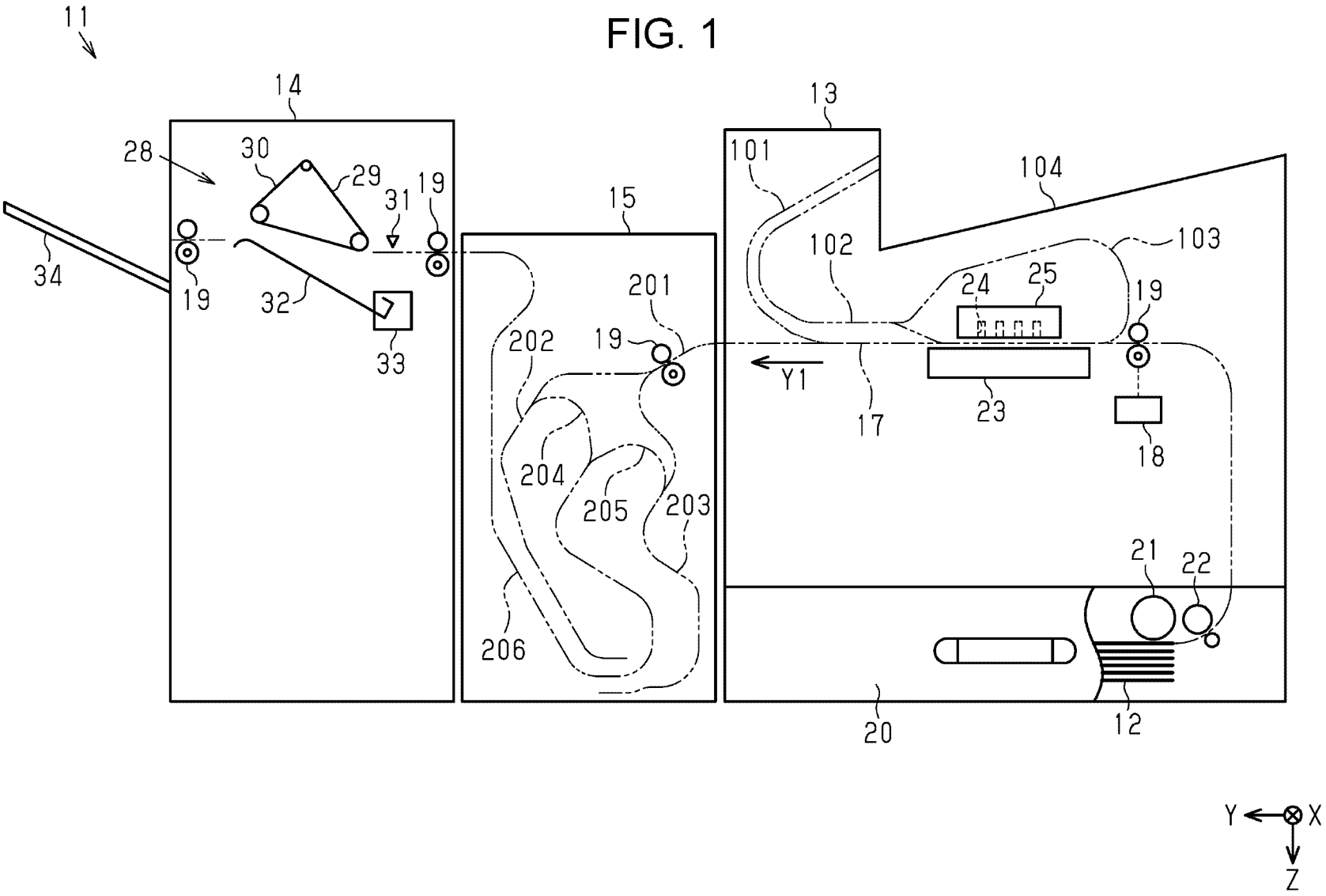
FIG. 1 is a schematic side view showing a medium processing system provided with a post-processing device in a first embodiment.

As shown in FIG. 1, a medium processing system 11 includes a printing device 13 that records on a medium 12, a post-processing device 14 that performs post-processing on the recorded medium 12, and an intermediate device 15 positioned between the printing device 13 and the post-processing device 14. The printing device 13 is, for example, an ink jet printer that ejects ink onto the medium 12 and prints characters and images. The post-processing device 14 performs stapling processing or the like for binding a plurality of media 12 as post-processing to be performed on the recorded media 12.

The medium processing system 11 is provided with a transport path 17 indicated by a two-dot chain line in FIG. 1 which continues from the printing device 13 to the post-processing device 14 via the intermediate device 15. The medium processing system 11 includes one or a plurality of transport roller pairs 19 that transport the medium 12 along the transport path 17 by driving a transport motor 18. The transport roller pair 19 in the intermediate device 15 and the post-processing device 14 may have the transport motor 18 in each device. Furthermore, the printing device 13, the intermediate device 15, and the post-processing device 14 may be provided with a plurality of transport motors 18.

In the drawings, the direction of gravity is shown on a Z axis assuming that the medium processing system 11 is placed on a horizontal plane, and the directions along the plane intersecting the Z axis are shown on X and Y axes. The X, Y, and Z axes may be orthogonal to one another, and the X and Y axes are along the horizontal plane. In the following description, the X-axis direction may be referred to as a width direction X, the Z-axis direction may be referred to as a vertical direction Z, and the direction orthogonal to the width direction X and along the transport path 17 may be also referred to as a first transport direction Y1. The first transport direction Y1 is a direction in which the transport roller pair 19 transports the medium 12 and is a direction from the printing device 13 on the upstream to the post-processing device 14 on the downstream.

The printing device 13 is detachably provided with a cassette 20 capable of accommodating the loaded media 12. The printing device 13 may be detachably provided with a plurality of cassettes 20. The printing device 13 includes a pick-up roller 21 for sending out the top medium 12 among the media 12 accommodated in the cassette 20 and a separation roller 22 for separating the media 12 sent out by the pick-up roller 21 one by one.

The printing device 13 includes a support portion 23 provided at a position along the transport path 17 and supporting the medium 12, and a recording head 25 for discharging the liquid from a nozzle 24 to the medium 12 supported by the support portion 23 to record. The recording head 25 is provided at a position facing the support portion 23 across the transport path 17. The recording head 25 may be a line head capable of simultaneously discharging the liquid in the width direction X, or may be a serial head for discharging the liquid while moving in the width direction X. In the present embodiment, the recording head 25 corresponds to an example of a processing unit that performs recording processing on the medium 12 as an example of processing.

The printing device 13 includes a discharge path 101 in which the medium 12 is discharged, a switchback path 102 in which the medium 12 is switched back, and a reverse path 103 in which the posture of the medium 12 is reversed, as part of the transport path 17. The medium 12 recorded by the recording head 25 is discharged to a discharge unit 104 through the discharge path 101.

When duplex printing is performed, the medium 12 printed on one side is transported to the switchback path 102, transported in the reverse direction, and transported from the switchback path 102 to the reverse path 103. The medium 12 reversed by the reverse path 103 is fed again to the recording head 25 and is printed by the recording head 25 on the side opposite to the side already printed. Thus, the printing device 13 performs duplex printing on the medium 12. The printing device 13 transports the printed medium 12 toward the discharge unit 104 or the intermediate device 15.

The intermediate device 15 includes an introduction path 201, a first switchback path 202, a second switchback path 203, a first merging path 204, a second merging path 205, and a delivery path 206, as part of the transport path 17.

The medium 12 transported from the printing device 13 to the intermediate device 15 is transported from the introduction path 201 to the first switchback path 202 or the second switchback path 203 by a flap (not shown) or the like.

The medium 12 transported to the first switchback path 202 is switched back in the first switchback path 202, and then transported to the delivery path 206 through the first merging path 204. On the other hand, the medium 12 transported from the introduction path 201 to the second switchback path 203 is switched back by the second switchback path 203, and then transported to the delivery path 206 through the second merging path 205.

In the intermediate device 15, because the medium 12 is switched back through the first switchback path 202 or the second switchback path 203, in the printing device 13, the surface printed immediately before is turned from the position facing upward to the position facing downward. As a result, the medium 12 delivered from the intermediate device 15 to the post-processing device 14 through the delivery path 206 has a posture in which the surface printed immediately before by the printing device 13 faces downward. In addition, by being transported in the intermediate device 15, the drying time of the medium 12 is secured, and transfer of the liquid discharged to the medium 12 and curling of the medium 12 by moisture of the discharged liquid can be suppressed.

Next, an embodiment of the post-processing device 14 will be described. As shown in FIG. 1, the post-processing device 14 includes a medium processing device 28 that performs post-processing on the introduced medium 12 after printing. The medium processing device 28 includes a transport mechanism 30 for transporting the medium 12 and an intermediate stacker 32 which is an example of a stacker for stacking the medium 12 transported by the transport mechanism 30. At a position on the upstream of the transport mechanism 30 in the first transport direction Y1, a detection unit 31 that detects the medium 12 is disposed. The transport mechanism 30 adsorbs and transports the medium 12 on the transport belt 29, peels the transported medium 12 from the transport belt 29, and receives the medium 12 in the intermediate stacker 32.

The post-processing device 14 includes a post-processing mechanism 33 for performing post-processing on the media 12 stacked in the intermediate stacker 32, and a discharge stacker 34 that stacks the media 12 sent out from the intermediate stacker 32.

Figure 2:
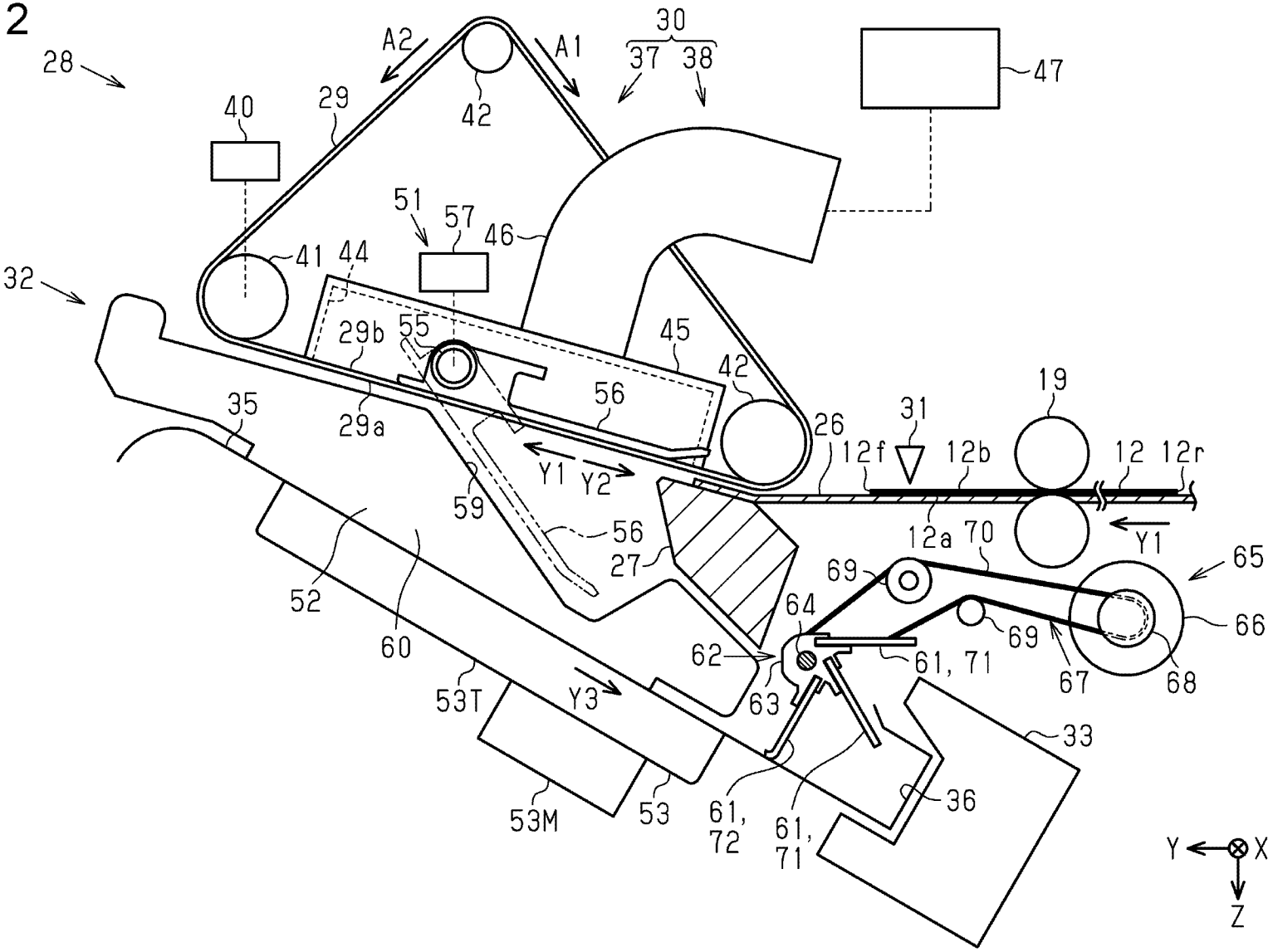
FIG. 2 is a schematic side view showing a medium processing device provided with a transport mechanism and a stacker in the post-processing device.

As shown in FIG. 2, the intermediate stacker 32 includes a medium stacking portion 35 that receives and stacks the medium 12 transported by the transport mechanism 30 after being processed by the recording head 25 which is an example of a processing unit in the printing device 13. In addition, the intermediate stacker 32 includes a medium butting portion 36 for aligning the medium 12 by contacting a rear end 12*r* as an example of a leading end portion that is the upstream end in the first transport direction Y1 of the medium 12 stacked on the medium stacking portion 35. The medium stacking portion 35 is obliquely provided so that the end on the medium butting portion 36 side is positioned on the lower side in the vertical direction Z than the end on the opposite side.

The transport mechanism 30 transports the medium 12 in the first transport direction Y1 and a second transport direction Y2 which is a direction opposite to the first transport direction Y1. The transport mechanism 30 is provided at a position above the intermediate stacker 32 in the vertical direction Z so that the intermediate stacker 32 and the transport belt 29 face each other. The transport mechanism 30 transports and discharges the medium 12 adsorbed on the transport belt 29 in the first transport direction Y1, and then switches the medium 12 back by reversely rotating the transport belt 29 to reversely transport the medium 12 in the second transport direction Y2. The transport mechanism 30 peels the medium 12 from the transport belt 29 and causes the medium stacking portion 35 to receive the medium 12 in the process of reversely transporting the medium 12 in the second transport direction Y2. The medium stacking portion 35 receives and stacks the medium 12 peeled off from the transport belt 29 in the process of being transported in the second transport direction Y2.

The transport mechanism 30 includes a rotating mechanism 37 that rotates the transport belt 29 and an attracting mechanism 38 that adsorbs the medium 12 onto the annular transport belt 29. The rotating mechanism 37 includes a belt motor 40 that rotates the transport belt 29, a drive pulley 41 that rotates by driving the belt motor 40, and a driven pulley 42 that is rotatable about an axis parallel to the axis of the drive pulley 41. The rotating mechanism 37 of the present embodiment includes two driven pulleys 42. The transport belt 29 is stretched around the drive pulley 41 and the driven pulley 42 in a triangular ring shape. The transport belt 29 travels the outside of the drive pulley 41 and the driven pulley 42 by driving the belt motor 40. Specifically, the rotating mechanism 37 rotates the transport belt 29 in a first rotation direction A1 by driving the belt motor 40 in a forward direction. The rotating mechanism 37 rotates the transport belt 29 in a second rotation direction A2 opposite to the first rotation direction A1 by driving the belt motor 40 in a reverse direction.

The attracting mechanism 38 includes the transport belt 29, a box-like suction portion 45 having a suction chamber 44, and a fan 47 for suctioning the inside of the suction chamber 44 via a duct 46. An outer surface of the transport belt 29 is an adsorption surface 29*a* that adsorbs the medium 12. The suction portion 45 is provided in contact with an inner surface 29*b* which is an inner surface of the transport belt 29 so that a part of the suction chamber 44 is covered by the transport belt 29.

Figure 3:
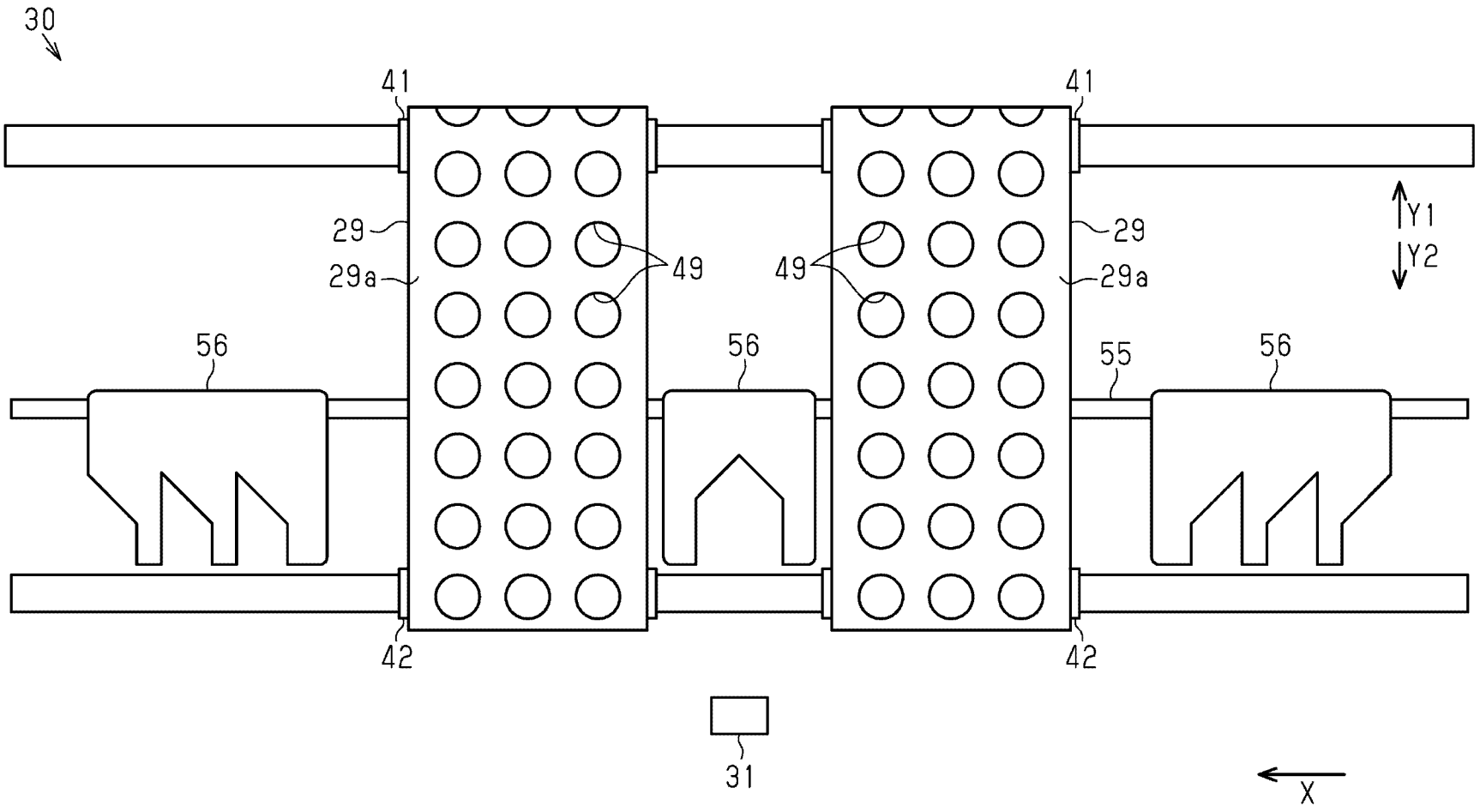
FIG. 3 is a schematic bottom view of a transport belt.

As shown in FIG. 3, a plurality of transport belts 29 are arranged side by side in the width direction X and stretched around the drive pulley 41 and the driven pulley 42. The transport belt 29 is formed with a large number of holes 49 communicating the adsorption surface 29*a* with the inner surface 29*b*. The number of transport belts 29 may be one.

As shown in FIG. 2, the attracting mechanism 38 makes the inside of the suction chamber 44 negative pressure as the fan 47 is driven and adsorbs the medium 12 on the adsorption surface 29*a* of the transport belt 29 through the holes 49 shown in FIG. 3 communicating with the suction chamber 44. That is, the attracting mechanism 38 adsorbs the medium 12 onto the transport belt 29 by a suction method of suctioning air from the holes 49 formed in the transport belt 29.

As shown in FIG. 2, the transport mechanism 30 adsorbs the medium 12 onto the transport belt 29 and rotates the transport belt 29 in this state to transport the medium 12 in the region between the transport belt 29 and the intermediate stacker 32. Specifically, the rotating mechanism 37 transports the medium 12 in the first transport direction Y1 by rotating the transport belt 29 having adsorbed the medium 12 in the first rotation direction A1. The rotating mechanism 37 transports the medium 12 in the second transport direction Y2 opposite to the first transport direction Y1 by rotating the transport belt 29 having adsorbed the medium 12 in the second rotation direction A2. The rotating mechanism 37 transports the medium 12 in the first transport direction Y1, and then switches the medium 12 back in the second transport direction Y2 to release the medium 12 from the transport belt 29 in the process of transporting in the second transport direction Y2, and causes the intermediate stacker 32 to stack the medium 12.

As shown in FIG. 2, the transport mechanism 30 includes a release mechanism 51 that releases the medium 12 adsorbed from the transport belt 29. In addition, the intermediate stacker 32 includes a pair of alignment members 52 for aligning the media 12 stacked in the medium stacking portion 35 in the width direction X, and a movement mechanism 53 that moves a pair of alignment members 52 in the width direction X. In FIG. 2, one alignment member 52 of the pair of alignment members 52 is illustrated. The movement mechanism 53 includes an electric motor 53M as a driving source, and a power transmission mechanism 53T that converts rotation by the power of the electric motor 53M into linear motion in the width direction X and transmits the motion.

The release mechanism 51 includes a movable guide 56 that can rotate around a guide shaft 55 and a guide motor 57 that rotates the guide shaft 55. The movable guide 56 is provided to be displaceable at a first guide position indicated by a solid line in FIG. 2 and at a second guide position indicated by a two-dot chain line in FIG. 2 closer to the intermediate stacker 32 than the first guide position by driving the guide motor 57.

The guide shaft 55 is provided at a position inside the transport belt 29 so as to extend in the width direction X. The movable guide 56 positioned at the first guide position is positioned further away from the intermediate stacker 32 than the transport belt 29 and positioned above the portion where the holes 49 communicating with the suction chamber 44 is formed in the adsorption surface 29*a*. The movable guide 56 positioned at the second guide position is partially positioned closer to the intermediate stacker 32 than the transport belt 29 and is in a posture of intersecting the adsorption surface 29*a* when viewed from the width direction X.

When the movable guide 56 is positioned at the first guide position, the leading end of the movable guide 56 separated from the guide shaft 55 is positioned downstream of the guide shaft 55 in the second transport direction Y2. The movable guide 56 is pivoted so that the leading end thereof is lowered from the first guide position and is disposed at the second guide position. The medium 12 which is adsorbed onto the transport belt 29 and is switched back from the first transport direction Y1 and transported in the second transport direction Y2 is peeled off from the adsorption surface 29*a* by the movable guide 56 positioned at the second guide position and guided in a direction obliquely downward to the downstream of the second transport direction Y2. At a position in the downstream of the movable guide 56 the second transport direction Y2, even if the portion of the medium 12 after being guided by the movable guide 56 positioned at the second guide position is lifted by curling or the like, a guide member 27 having a guide surface for guiding the medium 12 to the medium butting portion 36 is disposed.

The pair of alignment members 52 are provided at intervals in the width direction X. The alignment member 52 is formed with a notch 59 which allows the movement of the movable guide 56. When the movable guide 56 is positioned at the second guide position, contact with the alignment member 52 can be avoided via the notch 59. The alignment member 52 has an alignment surface 60 for aligning the medium 12 by contacting the end in the width direction X of the medium 12. The movement mechanism 53 moves the pair of alignment members 52 in accordance with the size of the medium 12 to be stacked on the intermediate stacker 32 so that the alignment surface 60 of the alignment member 52 and the end of the medium 12 in the width direction X contact each other. That is, the pair of alignment members 52 relatively move in the width direction X.

Figure 6:
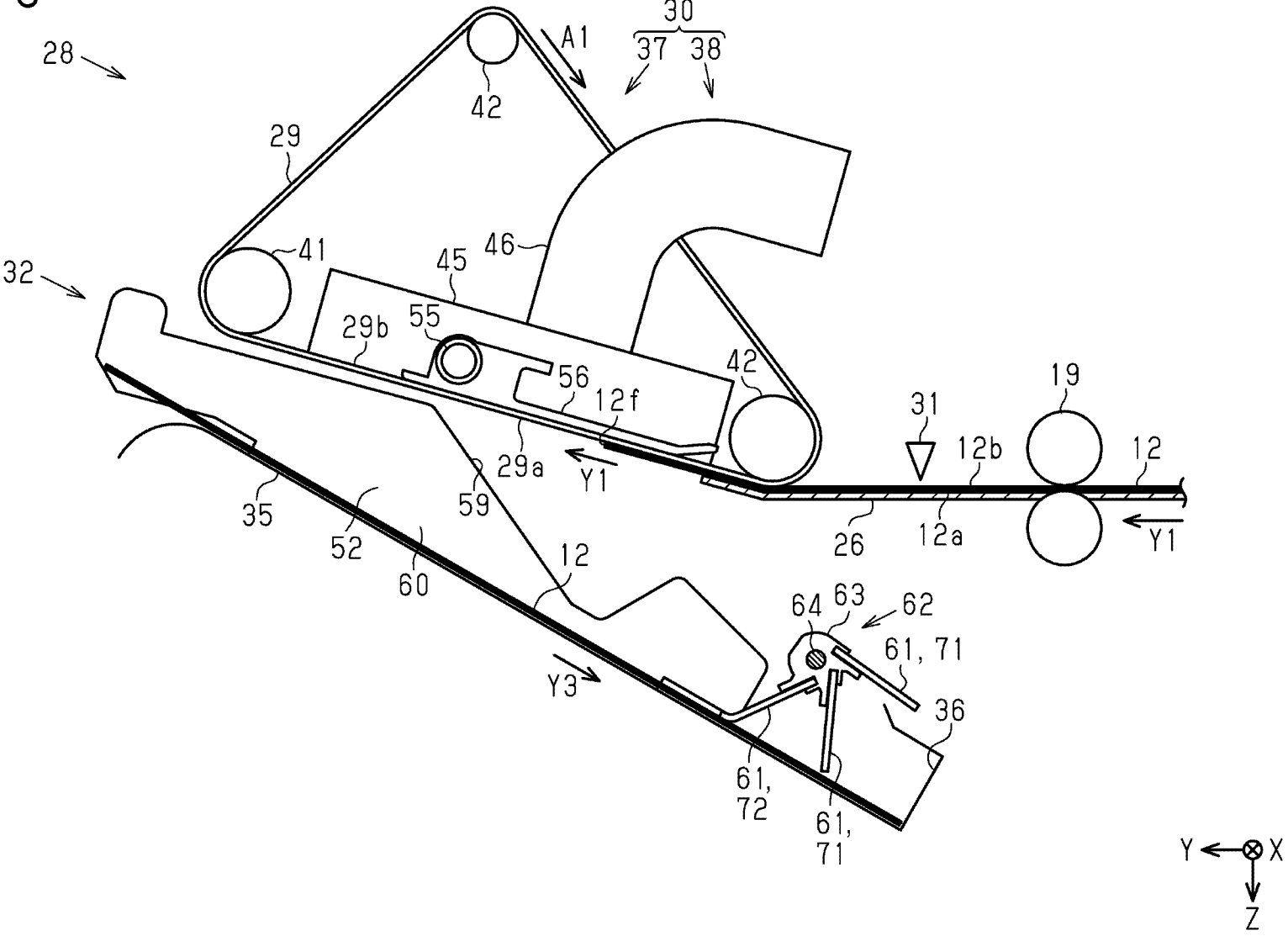
FIG. 6 is a schematic side view showing the medium processing device when the transport mechanism adsorbs the medium onto the transport belt.

As shown in FIG. 2, the intermediate stacker 32 includes a paddle 62 having a feeding portion 61 which contacts the surface of the medium 12 received by the medium stacking portion 35 to transport the medium 12 in a direction in which the leading end portion of the medium 12 abuts against the medium butting portion 36, that is, in a butting direction Y3. The paddle 62 rotates to feed the medium 12 received by the medium stacking portion 35 toward the medium butting portion 36 in the butting direction Y3. As shown in FIG. 6, when one subsequent medium 12 before being received in the medium stacking portion 35 is transported by the transport mechanism 30 in the first transport direction Y1, the paddle 62 is stopped in a state which a feeding portion 61 comes into contact with the medium 12 on the medium stacking portion 35 and is deformed. That is, when one medium 12 is transported by the transport mechanism 30 in the first transport direction Y1, which is the opposite direction to the butting direction Y3 when the medium 12 on the medium stacking portion 35 abuts against the medium butting portion 36, the paddle 62 is stopped in a state which the feeding portion 61 comes into contact with the medium 12 on the medium stacking portion 35 and is deformed.

The paddle 62 in this example includes three feeding portions 61. The three feeding portions 61 are fixed to a rotating member 63 constituting the paddle 62 and extend outward in a radial direction from the outer peripheral portion of the rotating member 63 at predetermined angular intervals in a circumferential direction. The rotating member 63 is supported by a rotation shaft 64 whose axial direction is the width direction X and is configured to be rotatable around the rotation shaft 64.

As shown in FIG. 2, the medium processing device 28 includes a drive mechanism 65 that rotates the paddle 62. The drive mechanism 65 includes an electric motor 66 serving as a driving source that outputs power for rotating the rotation shaft 64 of the paddle 62, and a power transmission mechanism 67 for transmitting the power of the electric motor 66 to the rotation shaft 64. The power transmission mechanism 67 includes a drive pulley 68 connected to the output shaft of the electric motor 66, one or more driven pulleys 69, and an endless belt 70 wound around each of the pulleys 68 and 69.

The paddle 62 can feed the medium 12 received by the medium stacking portion 35 in the butting direction Y3 toward the medium butting portion 36 by rotating in a rotational direction. That is, the paddle 62 rotates in the counterclockwise direction in FIG. 2. Two of the three feeding portions 61 are first feeding portions 71 which perform a feeding operation of pulling the medium 12 received by the medium stacking portion 35 in the butting direction Y3 toward the medium butting portion 36. In addition, when the feeding operation of pulling the medium 12 in the butting direction Y3 and the paddle 62 are stopped in the deformed state, the other one of the three feeding portions 61 is a second feeding portion 72 which performs a pressing operation of pressing the medium 12 in a state of coming into contact with the medium 12 on the medium stacking portion 35 and being deformed.

Figure 7:
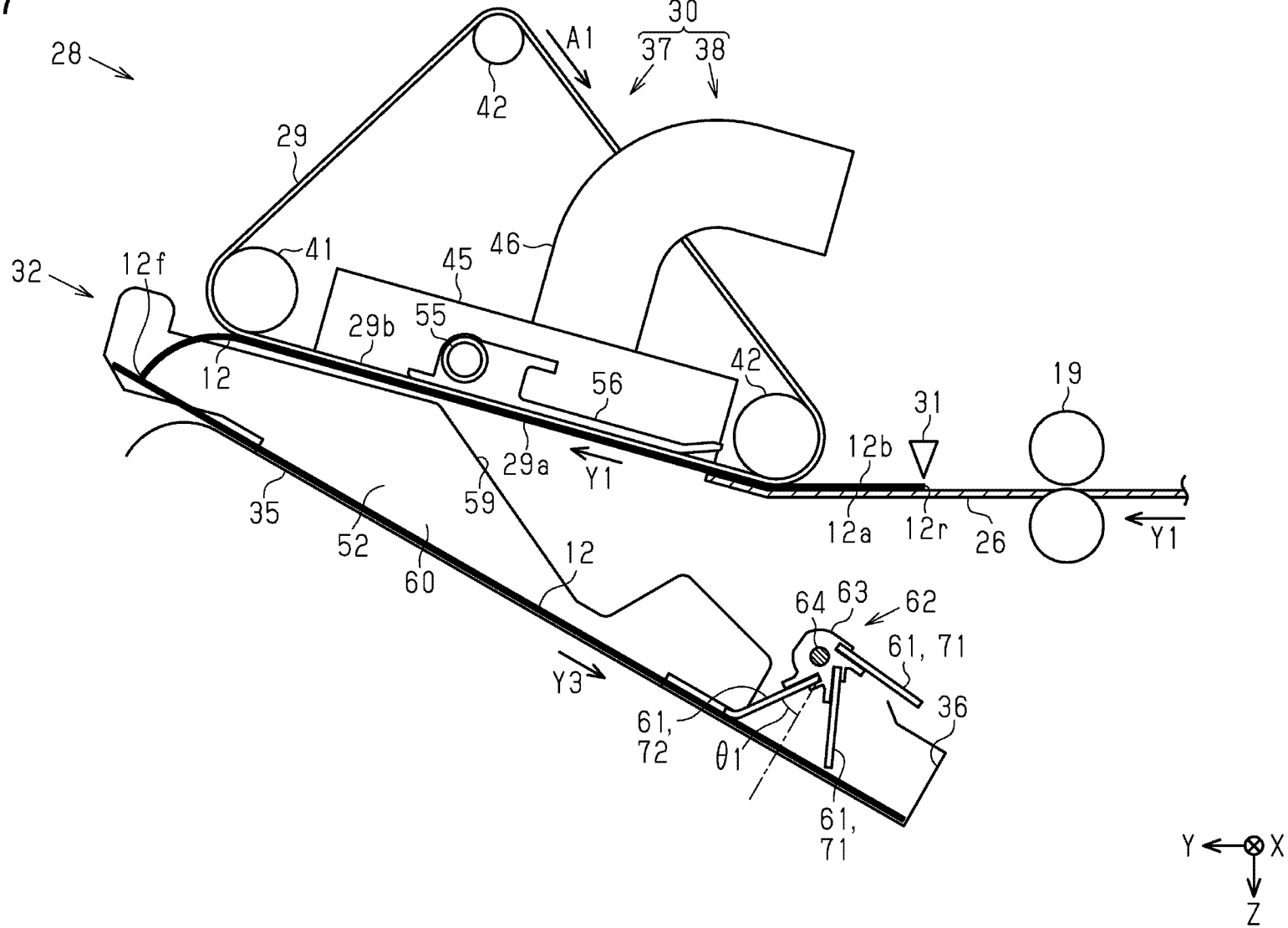
FIG. 7 is a schematic side view showing the medium processing device when the transport mechanism transports the medium adsorbed on the transport belt in a first transport direction.

As shown in FIGS. 6 and 7, the paddle 62 stops in a state in which the second feeding portion 72 comes into contact with the medium 12 on the medium stacking portion 35 and deformed. That is, it is a second mode in which the paddle 62 stops in a state in which the feeding portion 61 comes into contact with the medium on the medium stacking portion 35 and is deformed. While the paddle 62 rotates approximately once counterclockwise from the stop position in FIG. 6 or the retracted position shown in FIG. 17 to stop at the stop position again, the two first feeding portions 71 and one second feeding portion 72 sequentially contact the surface of the medium 12 newly received in the medium stacking portion 35 to feed the medium 12 in the butting direction Y3. As shown in FIG. 6, when the leading end portion of the medium 12 abuts against the medium butting portion 36 in the feeding operation and is aligned in the butting direction Y3, the second feeding portion 72 of the paddle 62 which has stopped after one rotation comes into contact with the medium 12 and is deformed, and presses the medium 12 in a state in which a pressing force is applied to the medium 12.

Here, the feeding portion 61 of the paddle 62 will be described. In a case where a plurality of feeding portions 61 include the first feeding portion 71 used for feeding, and the second feeding portion 72 used for feeding and pressing, the paddle 62 stops in a state in which the second feeding portion 72 comes into contact with the medium 12 on the medium stacking portion 35 and is deformed. The paddle 62 performs one rotation each time one medium 12 is received by the medium stacking portion 35. The second feeding portion 72 contacts the medium 12 on the medium stacking portion 35 at the end of one rotation. The second feeding portion 72 needs a pressing force of a certain level or more to hold the medium 12 in order to prevent the medium 12 from shifting in a state in which the second feeding portion 72 contacts and deforms the medium 12 when the paddle 62 is stopped.

On the other hand, if the first feeding portion 71 pushes the medium 12 too much in the process of feeding the medium 12, the frictional force between the medium 12 to be fed and the medium 12 therebelow makes the medium 12 to be fed less slippery, which hinders the smooth feeding operation of the medium 12. For this reason, the first feeding portion 71 and the second feeding portion 72 have the following characteristics because the frictional force with the medium 12 required for each is different.

First, as a first example, the feeding portion 61 includes the first feeding portion 71 having a first bending rigidity and the second feeding portion 72 having a second bending rigidity higher than the first bending rigidity. In addition to this, it is preferable that the static friction coefficient of the portion of the second feeding portion 72 in contact with the medium 12 be larger than the static friction coefficient of the portion of the first feeding portion 71 in contact with the medium 12.

In addition, as a second example, the feeding portion 61 includes the first feeding portion 71 a first static friction coefficient in the portion in contact with the medium 12, and the second feeding portion 72 having a second static friction coefficient in the portion in contact with the medium 12 that is larger than the first static friction coefficient.

Here, as the material of the feeding portion 61, rubber and elastomer may be used, and in addition to the material having elasticity, it is preferable that a member in the form of an elastic sheet including a synthetic resin sheet such as a polyethylene terephthalate (PET) sheet be used. In addition, in order to obtain the second bending rigidity greater than the first bending rigidity of the first feeding portion 71 as the bending stiffness of the second feeding portion 72, a reinforcing sheet such as a reinforcing PET sheet may be attached to a sheet made of rubber or elastomer constituting the second feeding portion 72.

The second feeding portion 72 pressing the medium 12 by coming into contact with the medium 12 and being deformed when the paddle 62 stops may have any one of the following configurations (a) to (c) with respect to the first feeding portion 71:

(a) The same material as the first feeding portion 71 and wider than the first feeding portion 71. (b) The same material as the first feeding portion 71 and thicker than the first feeding portion 71 (c) A material whose vertical elastic coefficient is larger than that of the first feeding portion 71. With the configuration of the above (a), a large frictional force can be obtained by the wide contact area, and with the configurations of the above (b) and (c), a large bending rigidity can be obtained. Furthermore, the second feeding portion 72 may be configured by combining two or three of (a) to (c) with respect to the first feeding portion 71.

Figure 12:
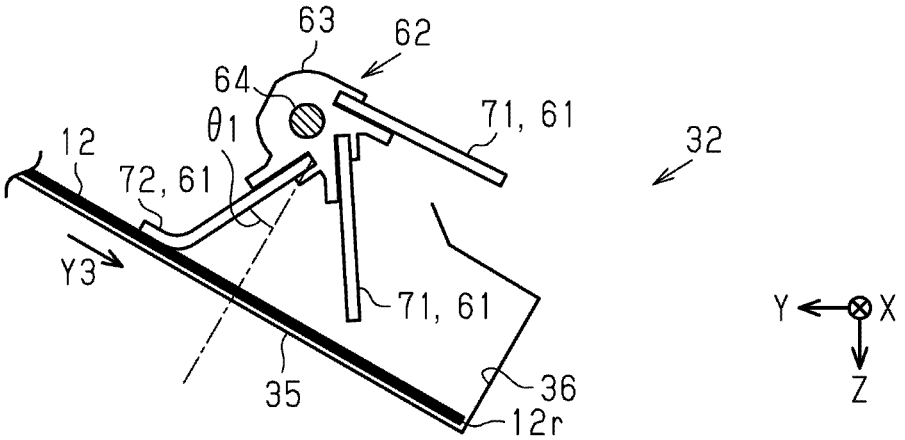
FIG. 12 is a schematic side view showing the feeding operation and a pressing operation of the paddle.
Figure 13:
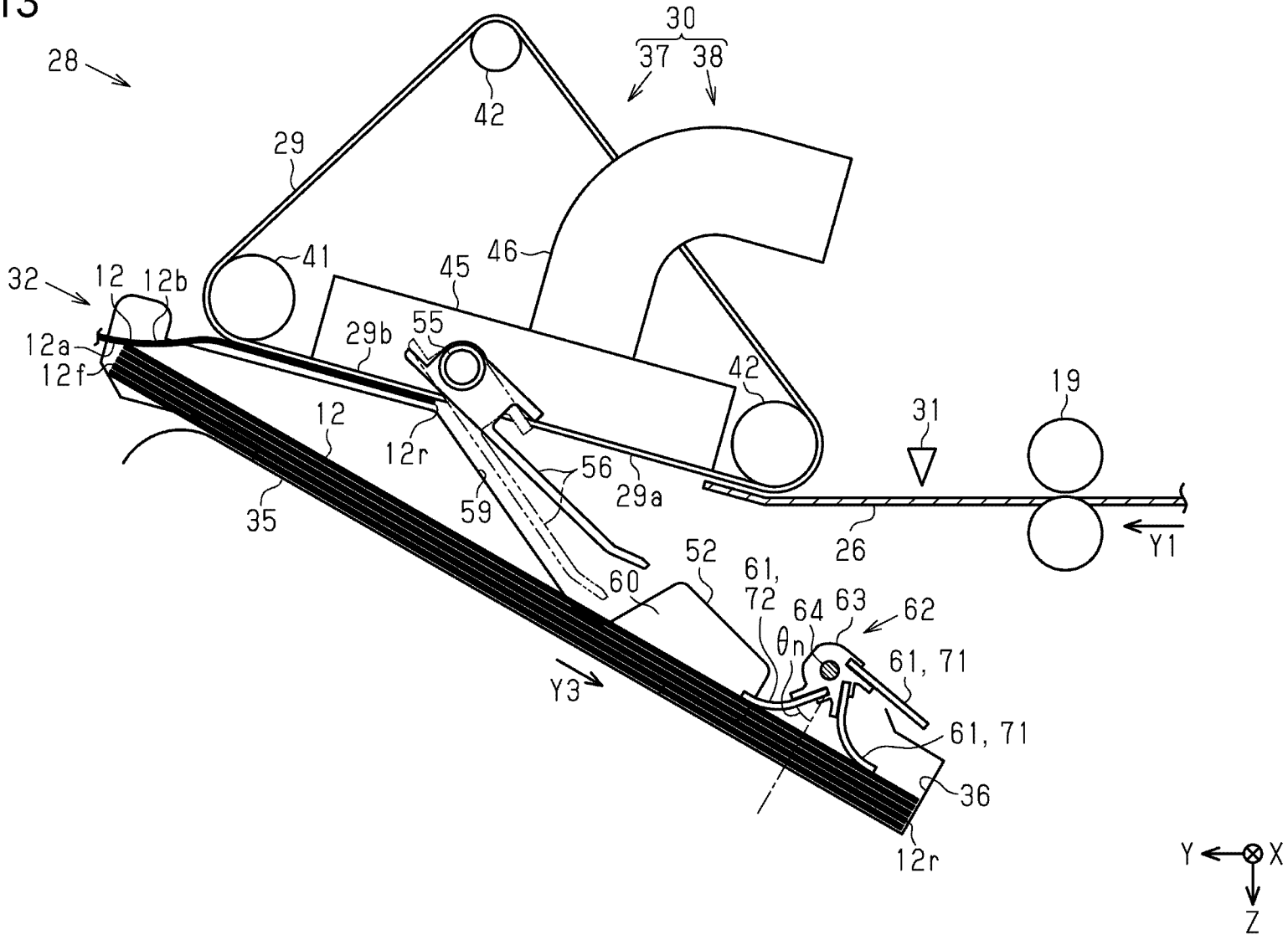
FIG. 13 is a schematic side view showing the pressing operation of the paddle in a state in which a plurality of media are stacked on the stacker.
Figure 16:
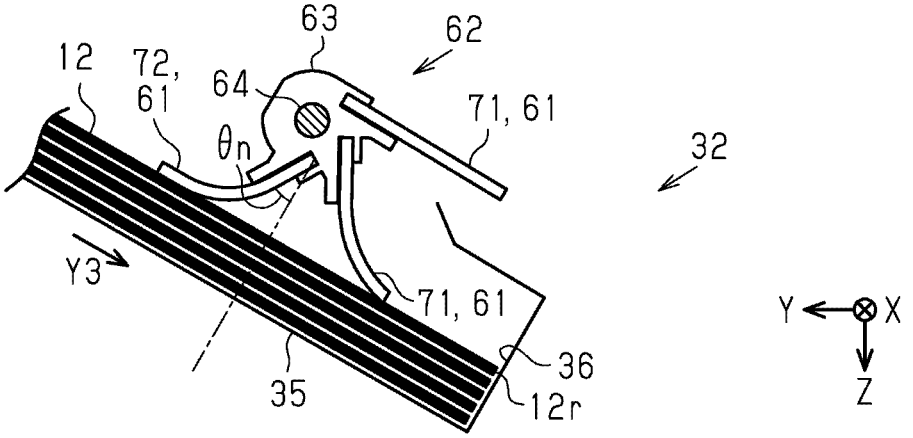
FIG. 16 is a schematic side view showing the feeding operation and the pressing operation of the paddle.

In addition, the stop position of the paddle 62 changes in accordance with the total thickness of the media 12 stacked in the medium stacking portion 35. In this example, as the total thickness of the media 12 stacked in the medium stacking portion 35 is thicker, the paddle 62 is stopped earlier. As shown in FIGS. 7 and 12, the rotation angle when the paddle 62 is stopped can be represented by an angle between the base portion of the feeding portion 61 in a state of coming into contact with the medium 12 on the medium stacking portion 35 and being deformed and a plane perpendicular to the bottom surface of the medium stacking portion 35 and parallel to the width direction X. As shown in FIGS. 7 and 12, an angle between the feeding portion 61 in a state of coming into contact with one medium 12 on the medium stacking portion 35 and being deformed and the plane perpendicular to the bottom surface of the medium stacking portion 35 and parallel to the width direction X is θ1. In addition, as shown in FIGS. 13 and 16, when the plurality of media 12 are stacked on the medium stacking portion 35, an angle between the feeding portion 61 in a state of coming into contact with the uppermost medium 12 among the media and being deformed and the plane perpendicular to the bottom surface of the medium stacking portion 35 and parallel to the width direction X is θn. Then, a second angle θn when the total thickness of the media 12 stacked on the medium stacking portion 35 is large, is larger than a first angle θ1 when the total thickness of the media 12 stacked on the medium stacking portion 35 is small (θ1<θn).

Figure 4:
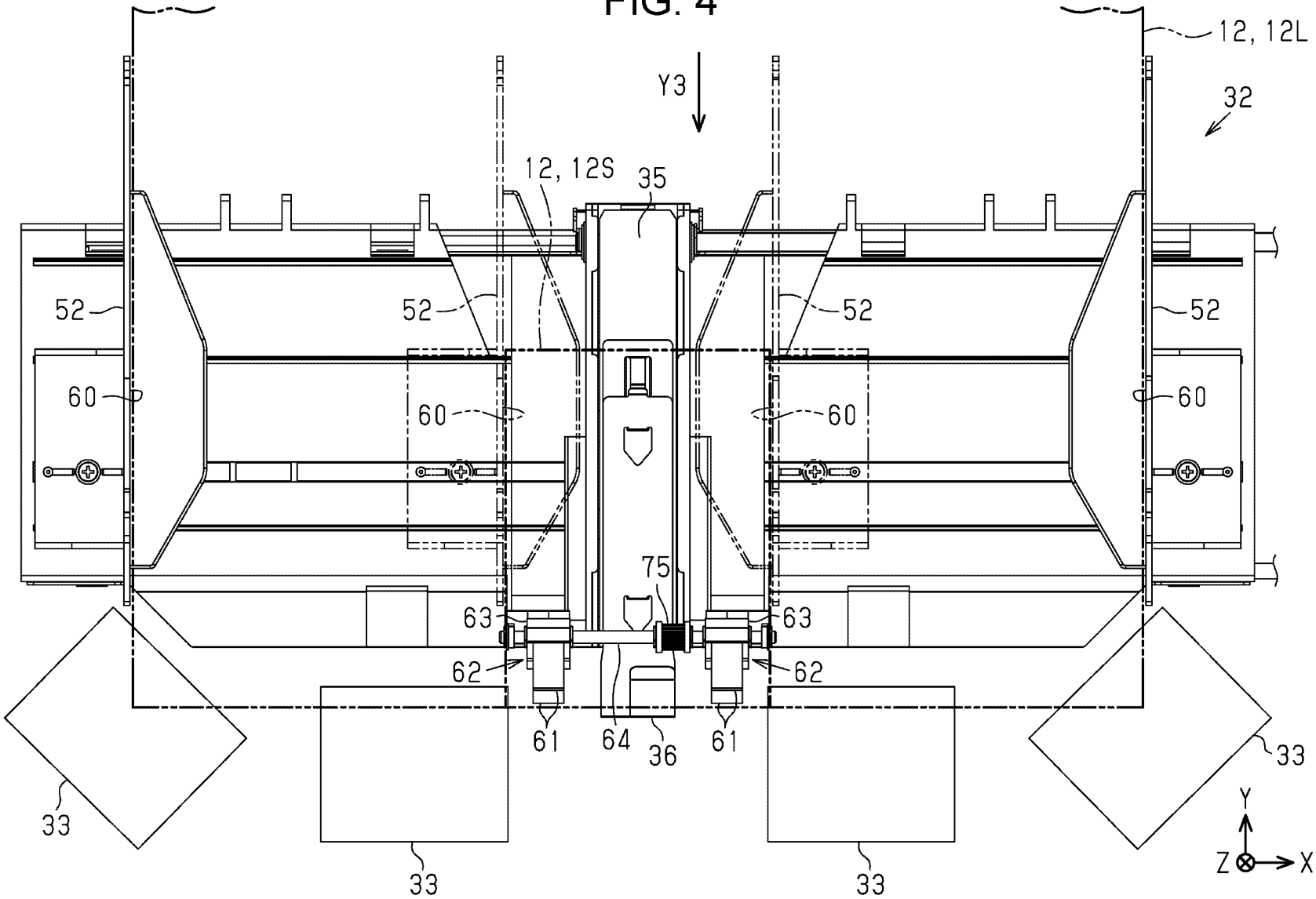
FIG. 4 is a plan view showing the stacker provided with a paddle.

As shown in FIG. 4, the medium stacking portion 35 constituting the intermediate stacker 32 has a length longer than the width of a medium 12L, which is assumed to be the maximum width, in the width direction X, and the pair of alignment members 52 are provided movably in the width direction X.

A power transmission mechanism 53T illustrated in FIG. 2 converts the power of the electric motor 53M into forward and reverse travelling of an endless belt stretched in the width direction X by, for example, a belt drive system. The belt is wound around a pair of pulleys (not shown) at both ends in the width direction X and has two mutually parallel belt portions that move in opposite directions when the belt travels. The pair of alignment members 52 are guided by a guide rod (not shown) and movably provided in the width direction X and is connected to each of the two belt portions. The power transmission mechanism 53T may be replaced with a belt drive system and may be another drive system such as a ball and screw drive system. In addition, the driving source is not limited to the electric motor 53M and may be, for example, an electric cylinder.

The pair of alignment members 52 move in opposite directions at the time of forward rotation driving and at the time of reverse rotation driving of the electric motor 53M. The pair of alignment members 52 is configured to be movable in the width direction X between a first position shown by a solid line in FIG. 4 which can guide the medium 12L of the maximum width in the width direction X and a second position shown by a two-dot chain line in FIG. 4 which can guide a medium 12S of the minimum width in the width direction X. When the electric motor 53M is driven in the forward direction, the pair of alignment members 52 move in the direction approaching each other, and when the electric motor 53M is driven in the reverse direction, the pair of alignment members 52 move in the direction moving away from each other. The pair of alignment members 52 can move to a standby position on the outer side in the width direction X than the first position shown by a solid line in FIG. 4 which can guide the medium 12L having the maximum width. The pair of alignment members 52 stand by at an interval wider than the width of the medium 12. Then, when the medium 12 is received in the medium stacking portion 35 by the transport mechanism 30, in the process until the medium 12 abuts on the medium stacking portion 35 by the medium butting portion 36, the medium 12 on the medium stacking portion 35 is aligned in the width direction X by intermittently driving from the standby position to an alignment position where the interval is the same as the width of the medium 12. A pulley 75 constituting the drive mechanism 65 is fixed to a portion between the pair of paddles 62 on the rotation shaft 64. One end portion of the belt 70 shown in FIG. 2 is wound around the pulley 75.

Figure 5:
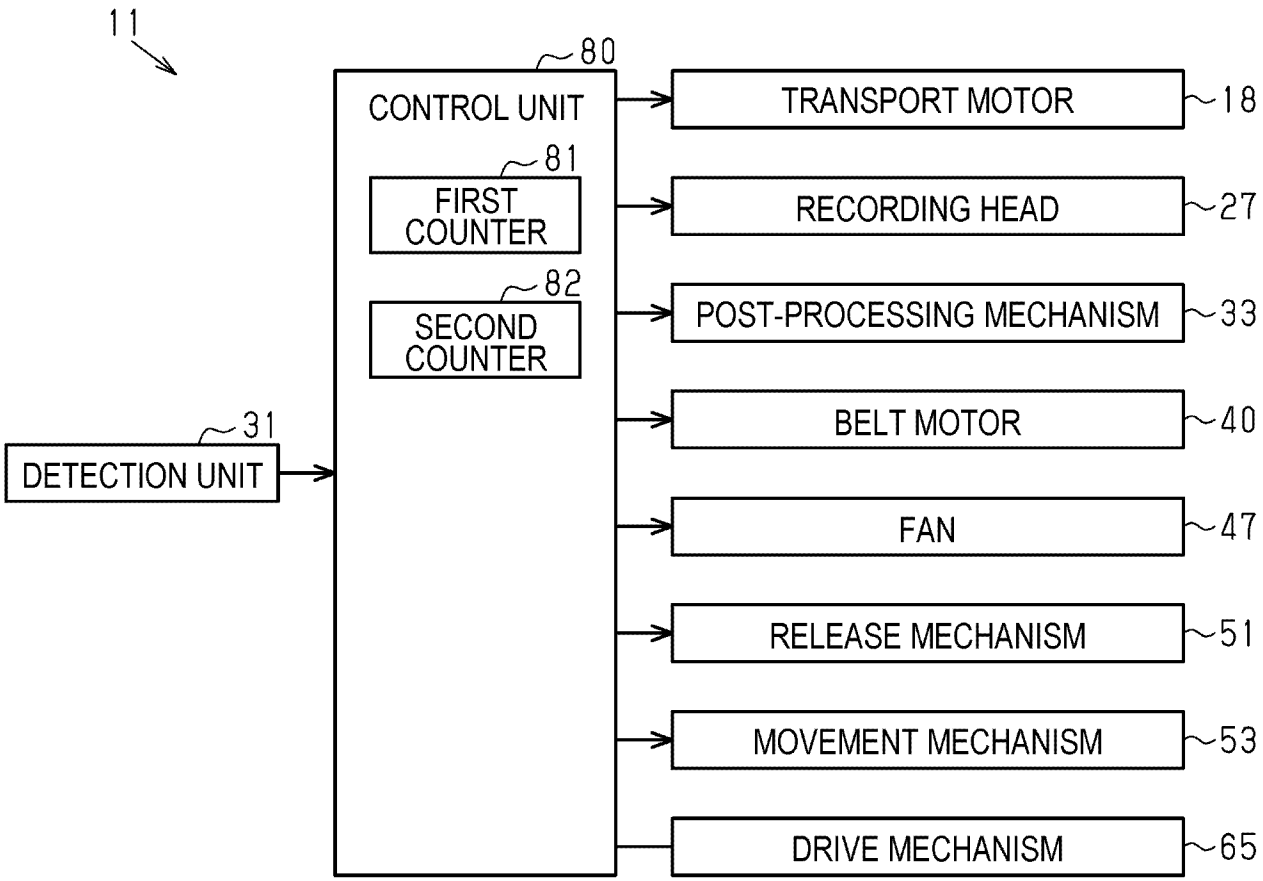
FIG. 5 is a block view showing an electrical configuration of the medium processing device.

Next, an electrical configuration of the medium processing system 11 will be described. As shown in FIG. 5, the medium processing system 11 includes a control unit 80 that centrally controls driving of each mechanism in the medium processing system 11. The detection unit 31 is electrically connected to the control unit 80. The control unit 80 receives a detection signal from the detection unit 31. The detection unit 31 detects the presence or absence of the medium 12 and detects the rear end 12*r* of the medium 12 by switching from the detection state of detecting the medium 12 to the non-detection state of not detecting the medium. The control unit 80 includes a first counter 81 and a second counter 82. After the detection unit 31 detects the rear end 12*r* of the medium 12, the first counter 81 counts a count value indicating the transport position of the medium 12 by counting the number of pulses of a pulse signal including a number of pulses proportional to the transport distance of the medium 12 output from an encoder (not shown) that detects the rotation of the transport roller pair 19. The second counter 82 counts the number of media 12 received by the medium stacking portion 35. The control unit 80 transmits signals to the transport motor 18, the recording head 25, the post-processing mechanism 33, the belt motor 40, the fan 47, the release mechanism 51, the movement mechanism 53, and the drive mechanism 65 to control the operation of each mechanism. The control unit 80 has, for example, a CPU and a memory (not shown), and performs various processing operations by the CPU executing a program stored in the memory.

Next, the operation of the medium processing system 11 will be described. In the printing device 13, the recording head 25 discharges the liquid to print on the medium 12, and the medium 12 after printing is reversed by the intermediate device 15 and then sent from the intermediate device 15 to the post-processing device 14. Thus, the medium 12 is sequentially carried into the post-processing device 14 in a posture in which an immediately preceding printed surface is the lower surface.

As shown in FIG. 2, the medium 12 carried into the post-processing device 14 is guided by a path forming member 26 by the transport roller pair 19 and transported in the first transport direction Y1. When the detection unit 31 detects the medium 12, the control unit 80 drives the fan 47 with the movable guide 56 positioned at the first guide position indicated by the solid line in FIG. 2 and drives the belt motor 40 in the forward direction to rotate the transport belt 29 in the first rotation direction A1.

As shown in FIG. 6, when the medium 12 is transported to the transport belt 29, the attracting mechanism 38 absorbs an upper surface 12*b* opposite to a lower surface 12*a* which is the printing surface immediately before the medium 12. When the medium 12 is absorbed to the adsorption surface 29*a* and transported in the first transport direction Y1 by the transport belt 29 rotating in the first rotation direction A1, the movable guide 56 is positioned at the first guide position above the adsorption surface 29*a*. Therefore, the medium 12 is transported in the first transport direction Y1 without coming into contact with the movable guide 56. In FIGS. 6 to 9, in order to describe the operation and function of the paddle 62, the paddle 62 is stopped in a state in which the medium stacking portion 35 has already received one medium 12 and one feeding portion 61 comes into contact with the medium 12 and is deformed.

As shown in FIG. 7, after the detection unit 31 detects the rear end 12*r* of the medium 12, when the first counter 81 which has started counting has finished counting the count value of a predetermined feeding amount, the control unit 80 determines that the rear end 12*r* has passed the guide shaft 55 of the movable guide 56 in the first transport direction Y1. The control unit 80 moves the movable guide 56 from the first guide position to the second guide position at this timing and drives the belt motor 40 in the reverse direction. That is, after the detection unit 31 detects the rear end 12*r*, when the rotation of the transport belt 29 in the first rotation direction A1 is continued until the medium 12 is transported in the first transport direction Y1 by the predetermined feeding amount, and the feeding of the medium 12 by the predetermined feeding amount is completed after the rear end 12*r* is detected, the control unit 80 rotates the transport belt 29 in the second rotation direction A2 after temporarily stopping the rotation of the transport belt 29.

The predetermined feeding amount is a feeding amount required for the rear end 12*r* of the medium 12 to pass the movable guide 56 completely. When the transport direction of the transport belt 29 is changed from the first rotation direction A1 to the second rotation direction A2 after the transport of the medium 12 of the predetermined feeding amount is completed, the rear end 12*r* of the medium 12 is positioned downstream of the guide shaft 55 of the movable guide 56 in the first transport direction Y1. That is, when the rear end 12*r* of the medium 12 reaches the switchback position past the guide shaft 55 of the movable guide 56 in the first transport direction Y1, the control unit 80 switches the transport direction of the medium 12 from the first transport direction Y1 to the second transport direction Y2. After the detection unit 31 detects the rear end 12*r* of the medium 12, the first counter 81 may count the elapsed time, and when the elapsed time reaches a predetermined time, the switchback of the medium 12 may be started.

As shown in FIG. 7, in the process of the medium 12 being adsorbed by the transport belt 29 and transported in the first transport direction Y1, the medium 12 hangs down at a portion downstream of the adsorbed portion of the transport belt 29 in the first transport direction Y1. When the hanging portion of the medium 12, for example, a front end 12*f* contacts the medium 12 on the medium stacking portion 35, the sliding resistance generates a force to shift the medium 12 on the medium stacking portion 35 in the first transport direction Y1.

However, in the present embodiment, in the process in which the subsequent medium 12 is transported by the transport mechanism 30 in the first transport direction Y1, the paddle 62 is stopped in a state in which the feeding portion 61 comes into contact with the medium 12 on the medium stacking portion 35 and is deformed. Therefore, the medium 12 on the medium stacking portion 35 is strongly pressed by the feeding portion 61 of the paddle 62. As a result, the medium 12 on the medium stacking portion 35 does not shift in the first transport direction Y1 even if a part of the medium that hangs down such as the front end 12*f* of the subsequent medium 12 slides. That is, the medium 12 on the medium stacking portion 35 is held in alignment.

In the present embodiment, the second feeding portion 72 having the second bending rigidity larger than the first bending rigidity of the first feeding portion 71 presses the medium 12 on the medium stacking portion 35. Instead of or in addition to this, the second feeding portion 72 having the second static friction coefficient larger than the first static friction coefficient of the first feeding portion 71 presses the medium 12 on the medium stacking portion 35. That is, by pressing the medium 12 in a state in which the second feeding portion 72 having a large second bending rigidity comes into contact with the medium 12 on the medium stacking portion 35 and is deformed, compared with the case of pressing the medium 12 in a state in which the first feeding portion 71 having the first bending rigidity comes into contact with the medium 12 and is deformed, a larger vertical drag is generated even if the feeding portions 71 and 72 have the same degree of deformation. Since the frictional force when the second feeding portion 72 presses the medium 12 is expressed by a static friction coefficient x a vertical drag, even if the feeding portions 71 and 72 have the same static friction coefficient, the second feeding portion 72 can press the medium 12 with a larger friction force.

In addition, by pressing the medium 12 in a state in which the second feeding portion 72 having a large second static friction coefficient comes into contact with the medium 12 on the medium stacking portion 35 and is deformed, compared with the case of pressing the medium 12 in a state in which the first feeding portion 71 having the first static friction coefficient comes into contact with the medium 12 and is deformed, even if the feeding portions 71 and 72 have the same bending rigidity and the same vertical drag, a larger frictional force is generated. That is, the second feeding portion 72 can press the medium 12 with a larger frictional force.

Furthermore, especially in this example, the second bending rigidity of the second feeding portion 72 is larger than the first bending rigidity of the first feeding portion 71, and the second static friction coefficient of the second feeding portion 72 is larger than the first static friction coefficient of the first feeding portion 71. Therefore, by pressing the medium 12 in a state in which the second feeding portion 72 comes into contact with the medium 12 on the medium stacking portion 35 and is deformed, the medium 12 can be pressed with a larger frictional force. As a result, even if a hanging part of the subsequent medium 12 being transported in the first transport direction Y1 slides on the medium 12 on the medium stacking portion 35, the medium 12 on the medium stacking portion 35 does not shift in the first transport direction Y1.

In particular, in an ink jet printer using a water-based ink, when a liquid such as ink is deposited on the medium 12, the sliding resistance when the media 12 slide is increased. Therefore, it is preferable to make the pressing of the medium 12 by the feeding portion 61 stronger as printing is performed with a larger discharge amount of the liquid to the medium 12. For example, the stop position of the paddle 62 is changed according to the amount of the liquid discharged to the medium 12 stacked in the medium stacking portion 35. In this example, as the amount of liquid discharged to the medium 12 stacked in the medium stacking portion 35 increases, the paddle 62 stops at a later timing. That is, the control unit 80 stops the paddle 62 at a later timing when a second amount of the liquid discharged to the medium 12 is larger than a first amount of the liquid discharged to the medium 12. The timing for stopping the paddle 62 is expressed by a rotation angle, and the same control as the control according to the total thickness of the media 12 stacked in the medium stacking portion 35 can be applied.

In a case where the number of stacked media 12 on the medium stacking portion 35 is the same, for the first discharge amount, an angle between the feeding portion 61 in a state of coming into contact with the medium 12 on the medium stacking portion 35 and being deformed and the plane perpendicular to the bottom surface of the medium stacking portion 35 and parallel to the width direction X is θi1. In addition, for the second discharge amount, an angle between the feeding portion 61 in a state of coming into contact with the medium 12 on the medium stacking portion 35 and being deformed and the plane perpendicular to the bottom surface of the medium stacking portion 35 and parallel to the width direction X is θi2. Then, the control unit 80 controls the timing at which the paddle 62 is stopped such that the second angle θi2 for the second discharge amount is smaller than the first angle θi1 for the first discharge amount (θi1>θi2). Here, the discharge amount of the liquid refers to an average discharge amount per unit area obtained by dividing the total discharge amount of the liquid discharged to one medium 12 by the area of the medium 12.

In addition, even if the amount of the discharged liquid is the same, as the thickness of the medium 12 decreases, the ratio of the liquid content per area of the medium 12 increases, and the sliding resistance of the medium 12 tends to increase. Therefore, as the thickness of the medium 12 increases, it is preferable to make the timing for stopping the paddle 62 earlier. The control unit 80 controls the timing at which the paddle 62 is stopped such that a second angle θt2 when the medium 12 has a second thickness larger than a first thickness is larger than a first angle θt1 when the medium 12 has the first thickness (θt1<θt2), In this way, even if the number of media 12 on the medium stacking portion 35 is the same, the control unit 80 controls the stop timing of the paddle 62 in accordance with one or both of the amount of the liquid discharged to the medium 12 and the thickness of the media 12. For this reason, when a hanging part such as the front end 12*f* of the subsequent medium 12 slides, the medium 12 on the medium stacking portion 35 does not shift in the first transport direction Y1 regardless of one or both of the amount of the liquid discharged to the medium 12 and the thickness of the media 12. That is, the medium 12 on the medium stacking portion 35 is held in alignment.

Figure 8:
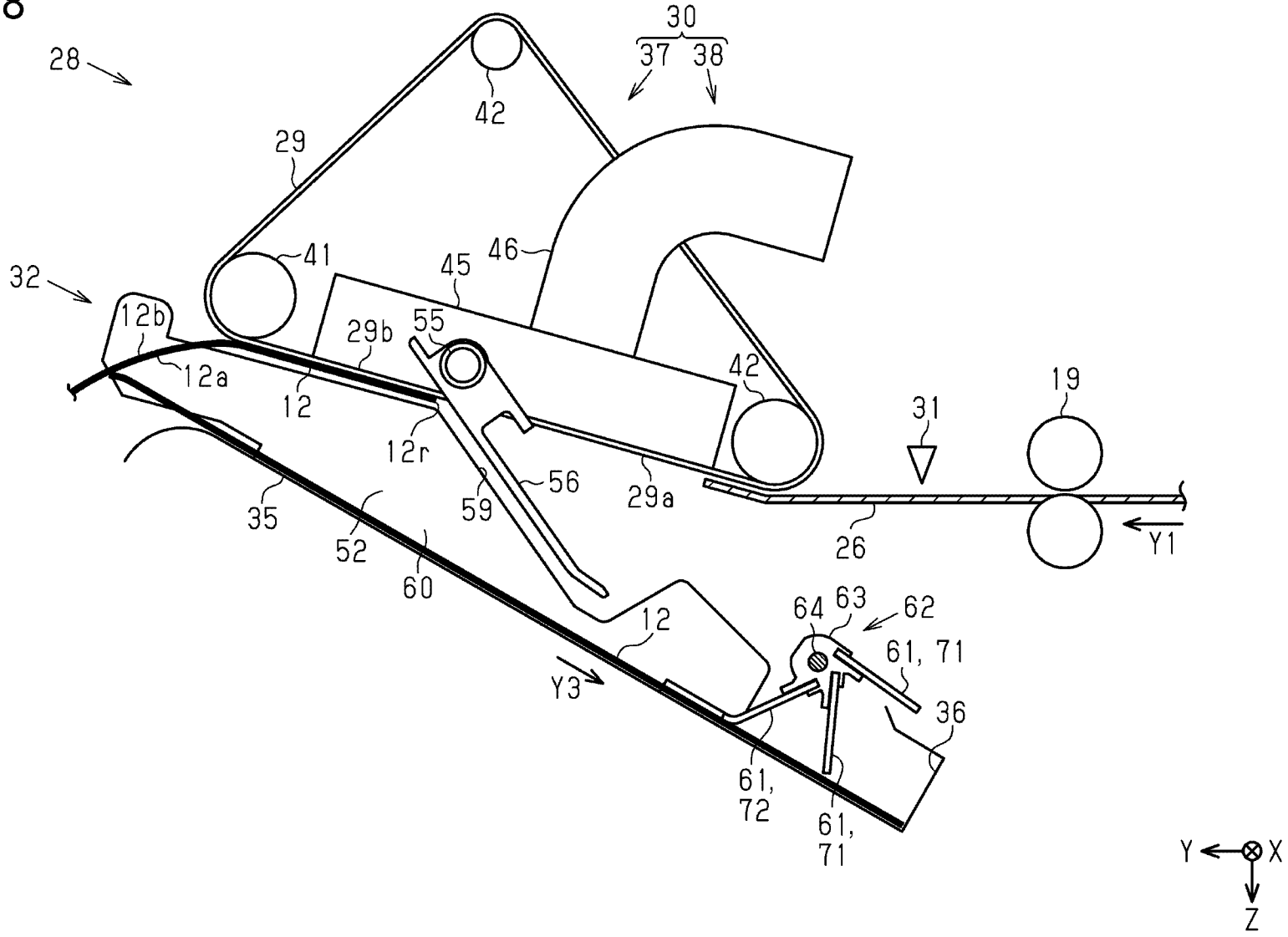
FIG. 8 is a schematic side view showing the medium processing device when a rotation direction of the transport belt is switched.

As shown in FIG. 8, while the transport of the medium 12 is stopped, the control unit 80 moves the movable guide 56 from the first guide position to the second guide position and rotates the transport belt 29 in the second rotational direction A2 with the movable guide 56 positioned at the second guide position. As shown in FIG. 8, when the transport belt 29 rotates in the second rotation direction A2, the medium 12 is transported in the second transport direction Y2.

Figure 9:
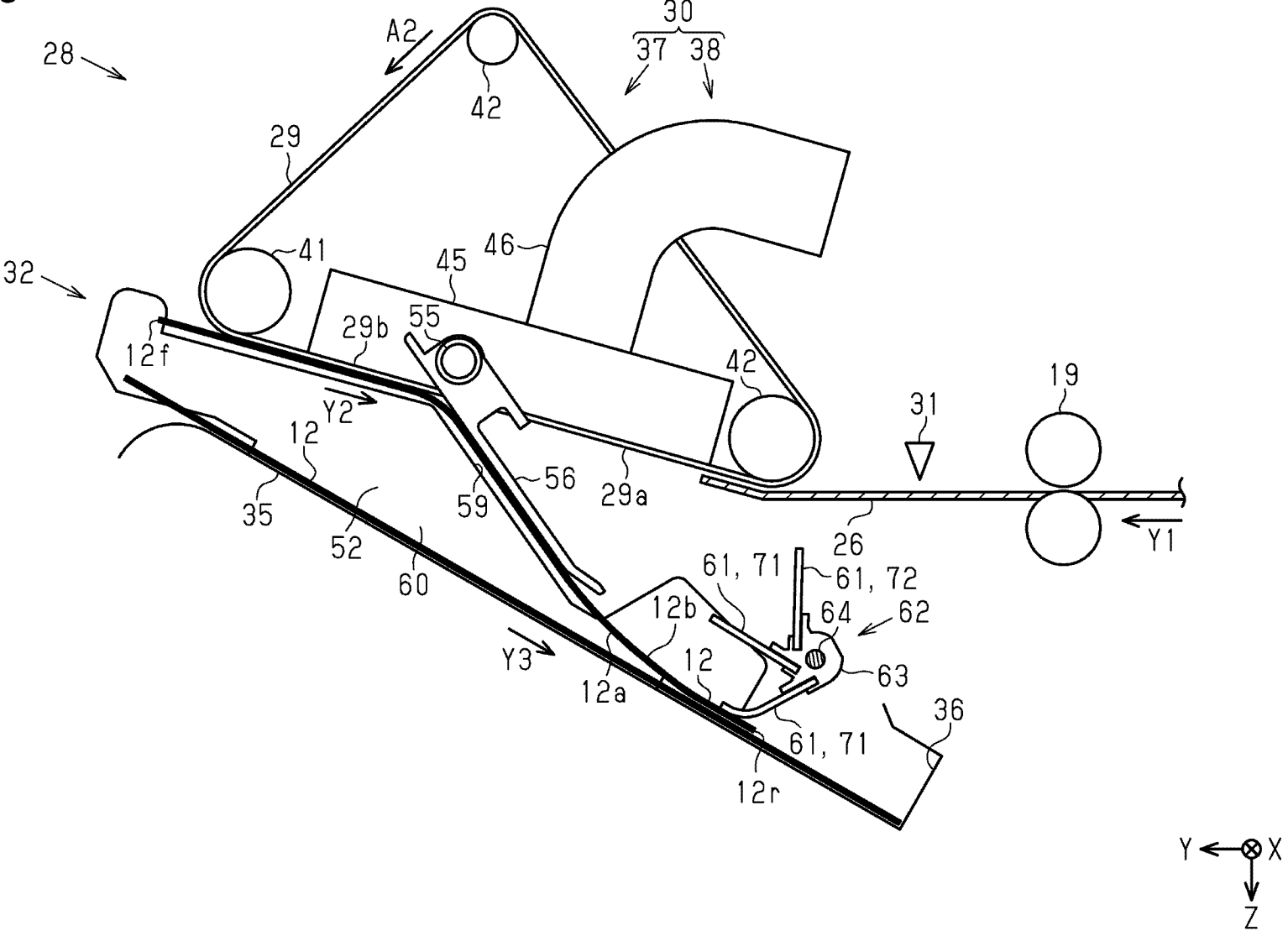
FIG. 9 is a schematic side view showing the medium processing device when the transport mechanism transports the medium in a second transport direction.

As shown in FIG. 9, the medium 12 transported in the second transport direction Y2 is guided obliquely downward separating from the adsorption surface 29*a* by contacting the movable guide 56 positioned at the second guide position and is peeled off from the adsorption surface 29*a*. The medium 12 peeled off from the adsorption surface 29*a* by the movable guide 56 is guided to the medium stacking portion 35 while moving in the butting direction Y3.

In the present embodiment, the control unit 80 resumes the rotation of the paddle 62 as the transport direction of one medium 12 transported by the transport mechanism 30 is switched from the first transport direction Y1 to the second transport direction Y2. In this case, the start timing of the rotation of the paddle 62 may be the same timing as the transport direction of one medium 12 is switched from the first transport direction Y1 to the second transport direction Y2, or may be timing after the switching.

Figure 10:
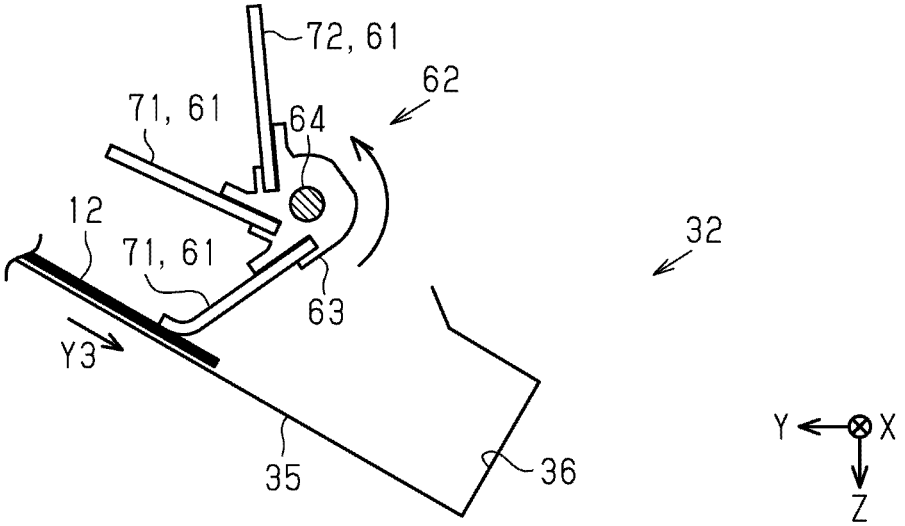
FIG. 10 is a schematic side view showing a feeding operation of the paddle.

For example, when the first medium 12 is received in the medium stacking portion 35, as shown in FIG. 10, if the paddle 62 starts to rotate, one of the first feeding portions 71 contacts the medium 12 newly received by the medium stacking portion 35 to feed the medium 12 in the butting direction Y3.

Figure 11:
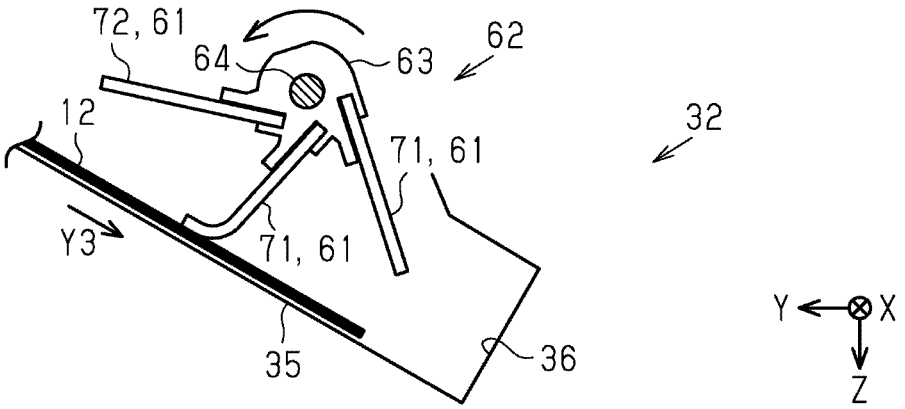
FIG. 11 is a schematic side view showing the feeding operation of the paddle.

Next, as shown in FIG. 11, the second first feeding portion 71 contacts the medium 12 to feed the medium 12 in the butting direction Y3. Further, as shown in FIG. 12, the third second feeding portion 72 contacts the medium 12 to feed the medium 12 in the butting direction Y3. The third second feeding portion 72 serves as a feeding portion for feeding the medium 12 at the end of one feeding operation for feeding one medium 12 in order to align in the butting direction Y3. The control unit 80 stops the rotation of the paddle 62 at the timing when the leading end of the medium 12 abuts against the medium butting portion 36 or at a slightly later timing. At this time, the control unit 80 controls the stop timing of the paddle 62 in a state in which the last second feeding portion 72 comes into contact with the medium 12 on the medium stacking portion 35 and is deformed. As described above, the stop timing of the paddle 62 is controlled in accordance with one or both of the amount of the liquid discharged to the medium 12 and the thickness of the medium 12. Then, as shown in FIG. 12, when the number of the media 12 is one, for example, the second feeding portion 72 presses the media 12 in a state of coming into contact with the media 12 and being deformed at the first angle θ1. Thus, in a state in which the paddle 62 is stopped, the medium 12 on the medium stacking portion 35 is in a state in which the rear end 12*r* abuts against the medium butting portion 36 and is aligned in the butting direction Y3.

In addition, in the process of sequentially feeding the media 12 received by the medium stacking portion 35 in the butting direction Y3 by the feeding portion 61 of the rotating paddle 62, an alignment operation in the width direction X of the media 12 is also performed. That is, the pair of alignment members 52 reciprocate intermittently from the standby position to the alignment position in a period other than a period in which the feeding portion 61 contacts the medium 12, thereby tapping both ends in the width direction X of the medium 12. That is, in the interval between the feeding operation of the feeding portion 61 feeding the medium 12, an alignment operation is performed in which the pair of alignment members 52 taps both ends of the medium 12 in the width direction X. As described above, the alignment operation in the width direction X of the medium 12 by the pair of alignment members 52 is performed at the timing when the feeding portion 61 does not contact the medium 12. In this way, the medium 12 is aligned on the medium stacking portion 35 in two directions of the butting direction Y3 and the width direction X.

Thereafter, when the subsequent medium 12 is transported by the transport mechanism 30 in the first transport direction Y1, the paddle 62 is in a stopped state, and the medium 12 on the medium stacking portion 35 is pressed by the second feeding portion 72 in a state of coming into contact with the medium 12 and being deformed. For this reason, even if a part of the subsequent medium 12 absorbed to the transport belt 29 hangs down at a position downstream of the transport belt 29 in the first transport direction Y1 slides on the medium 12 on the medium stacking portion 35, there is no concern that the medium 12 on the medium stacking portion 35 will be shifted in the first transport direction Y1 due to the sliding resistance. Then, the subsequent medium 12 is guided by the movable guide 56 positioned at the second guide position along with the switchback by the transport mechanism 30 and is guided to the medium stacking portion 35. The medium 12 newly received by the medium stacking portion 35 is sequentially fed by the two first feeding portions 71 and one second feeding portion 72 by the rotation of the paddle 62. Therefore, the rear end 12*r* of the medium 12 abuts against the medium butting portion 36, whereby the medium 12 is reliably aligned in the butting direction Y3. For this reason, misalignment does not occur because the rear end 12*r* of the medium 12 received by the medium stacking portion 35 does not abut against the medium butting portion 36. In addition, during the feeding process of the medium 12, the medium 12 is also aligned in the width direction X by the alignment operation by the pair of alignment members 52.

Thus, as shown in FIG. 13, the bundles of media 12 received one by one in the medium stacking portion 35 are stacked in an aligned state. In this state, the second feeding portion 72 presses the uppermost medium 12 in a state of coming into contact with the uppermost medium 12 and being deformed among the stacked media 12 on the medium stacking portion 35. When the uppermost medium 12 is introduced onto the medium 12 on the medium stacking portion 35 as a new subsequent medium 12 to reach the stacked state shown in FIG. 13, the rotation operation of the paddle 62 is performed as follows.

That is, under the condition that the uppermost medium 12 shown in FIG. 13 is still transported by the transport mechanism 30 and the movable guide 56 is positioned at the second guide position shown in FIG. 13 according to the switching of the transport direction from the first transport direction Y1 to the second transport direction Y2, the rotation of the paddle 62 is resumed. It is preferable that the second guide position of the movable guide 56 be changed according to the number of media 12 stacked on the medium stacking portion 35. In a case where the number of media 12 stacked in the medium stacking portion 35 is equal to or greater than a threshold value, the control unit 80 of the present example positions the second guide position of the movable guide 56 higher than the second guide position of the movable guide 56 indicated by a two-dot chain line in FIG. 13 when the number is less than the threshold value, as indicated by a solid line in FIG. 13.

Figure 14:
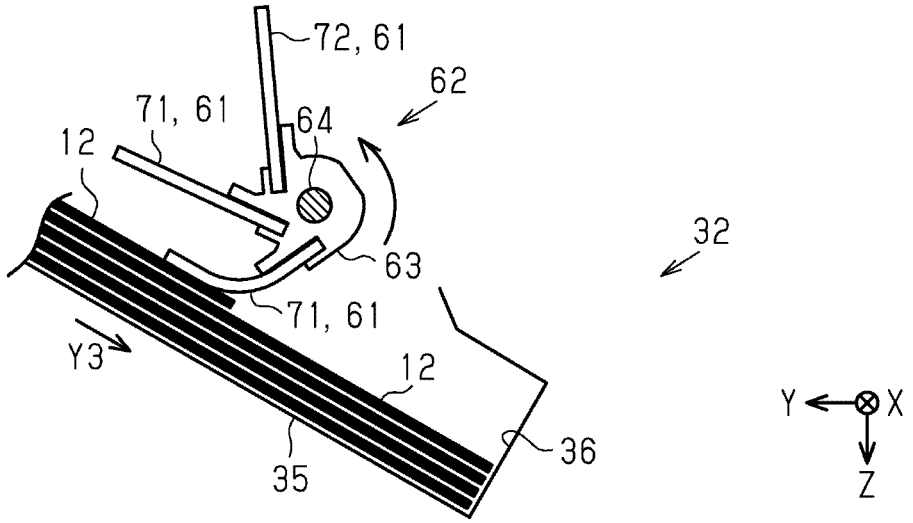
FIG. 14 is a schematic side view showing the feeding operation of the paddle.
Figure 15:
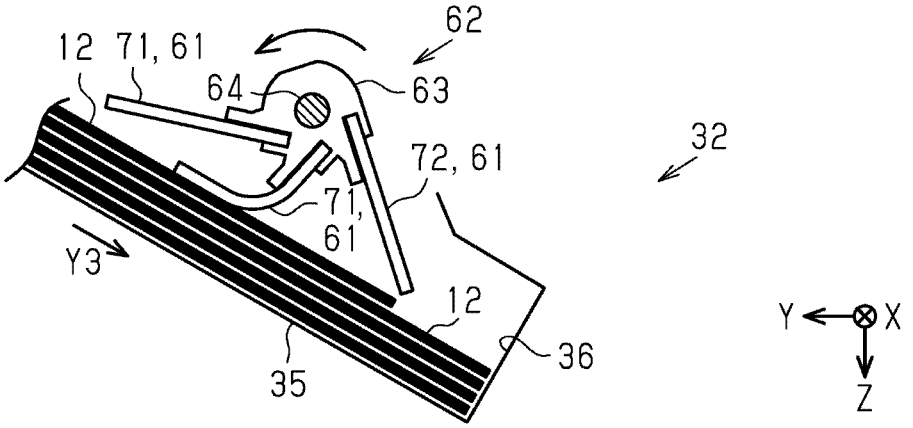
FIG. 15 is a schematic side view showing the feeding operation of the paddle.

As shown in FIG. 14, when the paddle 62 starts to rotate, one of the first feeding portions 71 contacts the medium 12 newly received by the medium stacking portion 35 to feed the medium 12 in the butting direction Y3. Next, as shown in FIG. 15, the second first feeding portion 71 contacts the medium 12 to feed the medium 12 in the butting direction Y3.

Furthermore, as shown in FIG. 16, the third second feeding portion 72 contacts the medium 12 to feed the medium 12 in the butting direction Y3. The control unit 80 stops the rotation of the paddle 62 at the timing when the leading end of the medium 12 abuts against the medium butting portion 36 or at a slightly later timing. At this time, the paddle 62 is stopped in a state in which the last second feeding portion 72 contacts the uppermost medium 12 of the media 12 on the medium stacking portion 35 in one feed operation. At this time, as shown in FIGS. 13 and 16, the second feeding portion 72 forms the second angle θn larger than the first angle θ1 with respect to a plane perpendicular to the stacking surface of the medium stacking portion 35 and parallel to the width direction X.

As described above, the stop position of the paddle 62 changes in accordance with the total thickness of the media 12 stacked on the medium stacking portion 35. In this example, as the total thickness of the media 12 stacked in the medium stacking portion 35 is thicker, the paddle 62 is stopped earlier. Therefore, the second angle θn when the plurality of media 12 are pressed is larger than the first angle θ1 when the one medium 12 is pressed on the medium stacking portion 35. For example, if the stop timing of the paddle 62 is a constant angle θ regardless of the total thickness, as the total thickness of the media 12 stacked in the medium stacking portion 35 is larger, the second feeding portion 72 when contacting the uppermost medium 12 is largely deformed. At this time, as the total thickness of the media 12 is thicker, the second feeding portion 72 is largely deformed, and the pressing force of the uppermost medium 12 becomes excessively large as compared with holding one medium 12. In this case, when the second feeding portion 72 is easily bent and the feeding portions 71 and 72 feed with an excessive pushing force, in a case where the feeding portions are rubbed between the medium 12 to be fed and the medium 12 located therebelow, there is a concern that the printing surface of the medium 12 will be damaged.

However, in the present embodiment, the medium 12 on the medium stacking portion 35 can be pressed with an appropriate frictional force within a certain range regardless of the total thickness. Therefore, the second feeding portion 72 is not easily bent, and there is no concern that the printing surface of the medium 12 will be damaged. Here, the appropriate frictional force within a certain range refers to a holding force that can be applied to the medium 12 within a certain range in which misalignment of the medium 12 received by the medium stacking portion 35 due to the sliding resistance can be suppressed when the medium 12 to be discharged or the medium 12 transported in the first transport direction Y1 contacts the medium 12 received by the medium stacking portion 35.

In addition, in the process in which the paddle 62 feeds the medium 12 received by the medium stacking portion 35, the medium 12 is also aligned in the width direction X when the pair of alignment members 52 tap both ends of the medium 12 in a period other than a period in which the feeding portion 61 contacts the medium 12. Thus, every time the subsequent medium 12 is newly transported by the transport mechanism 30, the pressing operation of the medium 12 on the medium stacking portion 35 by the paddle 62, the feeding operation of the medium 12 received in the medium stacking portion 35 by the paddle 62, and the alignment operation in the width direction X by the pair of alignment members 52 are performed. Then, when the paddle 62 is stopped after one feeding operation, the second feeding portion 72 presses the uppermost medium 12 in a state of coming into contact with the medium 12 and being deformed.

Figure 17:
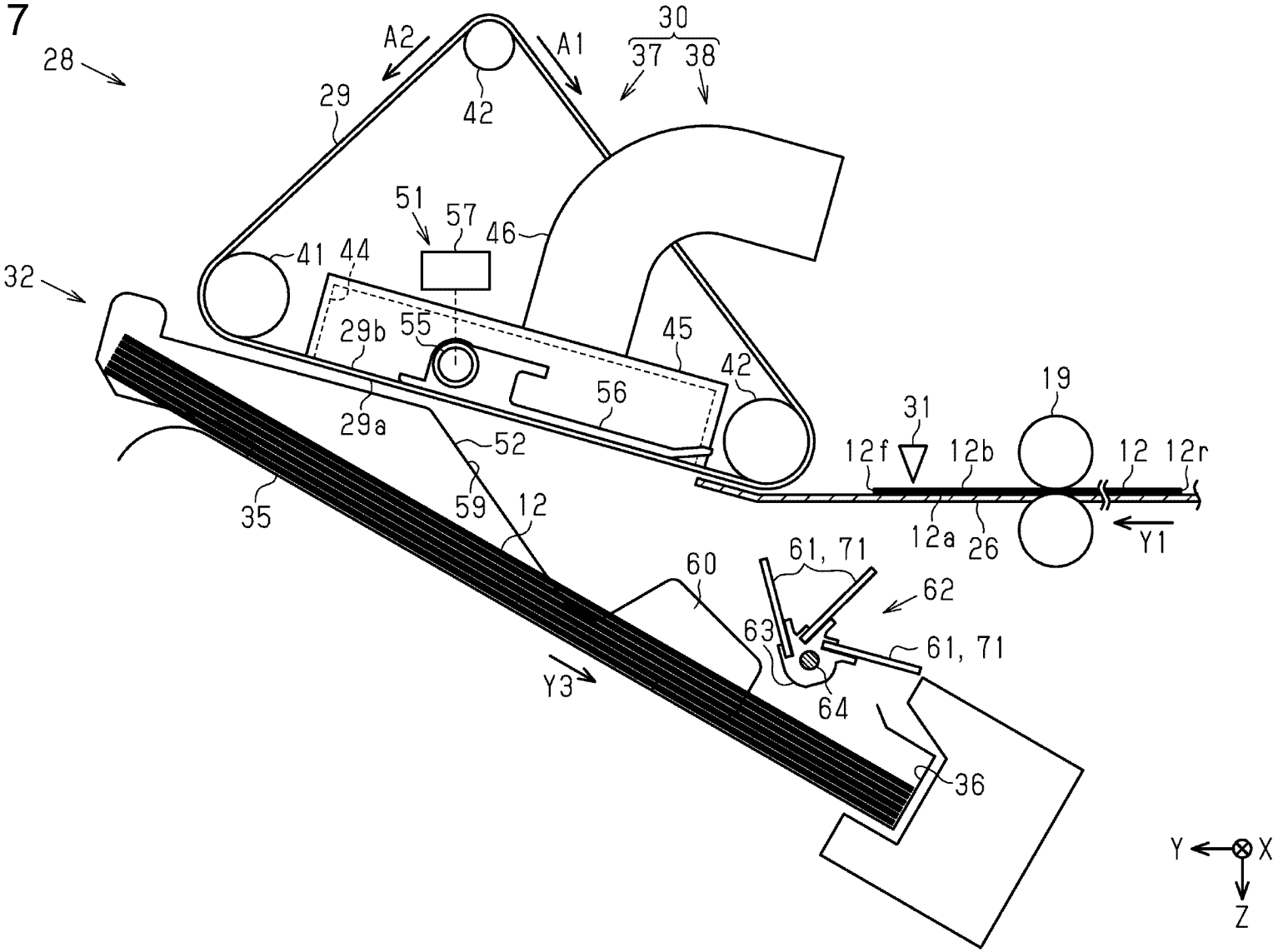
FIG. 17 is a schematic side view showing a state in which the media for one time of post-processing are stacked on the stacker.

In the present embodiment, every time the medium processing device 28 in the post-processing device 14 finishes stacking a predetermined number of media 12 on the medium stacking portion 35, the paddle 62 rotates to the retracted position shown in FIG. 17 which does not interfere with the stapling processing of the post-processing mechanism 33 and stops in the retracted state. That is, the feeding portion 61 does not contact the medium 12 on the medium stacking portion 35, and the feeding portion 61 is in a first mode of being stopped in a non-deformed state. In a retracted state of the paddle 62, the post-processing mechanism 33 staples the bundle of the media 12 stacked in the aligned state on the medium stacking portion 35. The bundle of media 12 that has been bound after finishing the post-processing is pushed out of the medium stacking portion 35 in the first transport direction Y1 by a pushing mechanism (not shown) and discharged to the discharge stacker 34. As a result, in the intermediate stacker 32, the medium stacking portion 35 is in an empty state as shown in FIG. 2 when the paddle 62 is in the retracted position shown in FIG. 17. Thereafter, until the subsequent medium 12 is sequentially transported by the transport mechanism 30, and the next bundle of the medium 12 is stacked on the medium stacking portion 35, the pressing of the medium 12 by the paddle 62 and the feeding operation of the medium 12 by the paddle 62 are similarly repeated.

According to the above embodiment, the following effects can be obtained. (1) The intermediate stacker 32 includes the medium stacking portion 35 for receiving and stacking the medium 12 which has been subjected to printing processing and discharged by the recording head 25 which is an example of a processing unit, the medium butting portion 36 for aligning the medium 12 by coming into contact with the leading end of the medium 12, and the feeding portion 61, and the paddle 62 for transporting the medium 12 received by the medium stacking portion 35 in the direction of the medium butting portion 36 by rotating. Furthermore, the intermediate stacker 32 has a first mode in which the paddle 62 stops in a state in which the feeding portion 61 does not contact the medium 12 on the medium stacking portion 35 and is not deformed, and a second mode in which the paddle 62 stops in a state in which the feeding portion 61 comes into contact with the medium 12 on the medium stacking portion 35 and is deformed. Therefore, the medium 12 received in the medium stacking portion 35 can be fed by the feeding portion 61 and can be aligned on the medium stacking portion 35 when the medium 12 abuts against the medium butting portion 36. Furthermore, the feeding portion 61 comes into contact with the medium 12 aligned on the medium stacking portion 35 and is deformed while the paddle 62 is stopped until the next medium 12 is received in the medium stacking portion 35 after the alignment, thereby holding the medium 12 by applying the pressing force to the medium 12.

(2) When one medium 12 is discharged, the intermediate stacker 32 stops the paddle 62 in a state in which the feeding portion 61 comes into contact with the medium 12 on the medium stacking portion 35 and is deformed. Therefore, the feeding portion 61 comes into contact with the medium 12 aligned on the medium stacking portion 35 and is deformed while the paddle 62 is stopped until the next medium 12 is received in the medium stacking portion 35 after the alignment, thereby holding the medium 12 by applying the pressing force to the medium 12. For example, when one medium 12 is discharged in the first transport direction Y1, misalignment of the medium 12 on the medium stacking portion 35 caused by the medium 12 coming into contact with the medium 12 aligned on the medium stacking portion 35 can be suppressed. In addition, the feeding operation and the pressing operation can be performed by one rotation operation of the paddle 62. Therefore, compared to the configuration in which the feeding operation and the pressing operation of the medium 12 are performed by different mechanisms, the time required for these operations can be shortened. Therefore, post-processing of the medium 12 by the post-processing device 14 can be performed at high speed.

(3) The intermediate stacker 32 includes the medium stacking portion 35 for receiving and stacking the medium 12 transported in the second transport direction Y2 opposite to the first transport direction Y1 after being transported in the first transport direction Y1, the medium butting portion 36 for aligning the medium 12 by coming into contact with the leading end of the medium 12, the feeding portion 61, the paddle 62 for transporting the medium 12 received by the medium stacking portion 35 in the direction of the medium butting portion 36 by rotating. Furthermore, the intermediate stacker 32 has a first mode in which the paddle 62 stops in a state in which the feeding portion 61 does not contact the medium 12 on the medium stacking portion 35 and is not deformed, and a second mode in which the paddle 62 stops in a state in which the feeding portion 61 comes into contact with the medium 12 on the medium stacking portion 35 and is deformed. Therefore, after being transported in the first transport direction Y1, the medium 12 transported in the second transport direction Y2 is received in the medium stacking portion 35. The medium 12 received in the medium stacking portion 35 can be fed by the feeding portion 61 and can be aligned on the medium stacking portion 35 when the medium 12 abuts against the medium butting portion 36. Furthermore, the feeding portion 61 comes into contact with the medium 12 aligned on the medium stacking portion 35 and is deformed while the paddle 62 is stopped until the next medium 12 is received in the medium stacking portion 35 after the alignment, thereby holding the medium 12 by applying the pressing force to the medium 12.

(4) When one medium 12 is transported in the first transport direction Y1, the intermediate stacker 32 stops the paddle 62 in a state in which the feeding portion 61 comes into contact with the medium 12 on the medium stacking portion 35 and is deformed. Therefore, after being transported in the first transport direction Y1, the medium 12 transported in the second transport direction Y2 is received in the medium stacking portion 35. The medium 12 received in the medium stacking portion 35 can be fed by the feeding portion 61 and can be aligned on the medium stacking portion 35 when the medium 12 abuts against the medium butting portion 36. Furthermore, the feeding portion 61 comes into contact with the medium 12 aligned on the medium stacking portion 35 and is deformed while the paddle 62 is stopped until the next medium 12 is received in the medium stacking portion 35 after the alignment, thereby holding the medium 12 by applying the pressing force to the medium 12. For example, when one medium 12 is transported in the first transport direction Y1 in the process of switchback, misalignment of the medium 12 on the medium stacking portion 35 caused by the medium 12 coming into contact with the medium 12 aligned on the medium stacking portion 35 can be suppressed.

(5) The paddle 62 resumes to rotate as the transport direction of one medium 12 switches from the first transport direction Y1 to the second transport direction Y2. In this case, the timing of resuming the rotation of the paddle 62 may be simultaneous with the switching of the transport direction of one medium 12 from the first transport direction Y1 to the second transport direction Y2 or may be after the switching. When the rotation of the paddle 62 is stopped at the timing when the leading end of the medium 12 abuts against the medium butting portion 36, the paddle 62 is controlled to be stopped so that the first feeding portion 61 comes in contact with the medium 12 on the medium stacking portion 35 and is deformed. Therefore, the medium 12 received by the medium stacking portion 35 can be aligned by feeding the medium 12 received by the medium stacking portion 35 in the butting direction Y3 by the feeding portion 61 of the rotating paddle 62.

(6) The feeding portion 61 includes the first feeding portion 71 having a first bending rigidity and the second feeding portion 72 having a second bending rigidity higher than the first bending rigidity. The paddle 62 stops in a state which the second feeding portion 72 comes into contact with the medium 12 on the medium stacking portion 35. Thus, the medium 12 on the medium stacking portion 35 can be pressed with a strong frictional force. Here, the frictional force is represented by a static friction coefficient x a vertical drag. By stopping the paddle 62 in a state in which the second feeding portion 72 having the second bending rigidity comes into contact with the medium and is deformed, compared to the case of stopping the paddle 62 in a state in which the first feeding portion 71 having the first bending rigidity comes into contact with the medium 12 and is deformed, a larger vertical drag can be generated. Therefore, the medium 12 on the medium stacking portion 35 can be pressed by the second feeding portion 72 with a strong frictional force.

(7) The static friction coefficient of the portion of the second feeding portion 72 in contact with the medium 12 is larger than the static friction coefficient of the portion of the first feeding portion 71 in contact with the medium 12. Here, the vertical drag for pressing the medium 12 of the medium stacking portion 35 is represented by a static friction coefficient x a vertical drag. By stopping the second feeding portion 72 in a state in which the second feeding portion having both a static friction coefficient and a vertical drag larger than those of the first feeding portion 71, comes into contact with the medium 12 and is deformed, compared to the case of stopping the first feeding portion 71 in a state in which the first feeding portion comes into contact with the medium 12 and is deformed, the medium 12 on the medium stacking portion 35 can be pressed with a stronger frictional force.

(8) The feeding portion 61 includes the first feeding portion 71 in which a static friction coefficient in the portion in contact with the medium 12 is a first static friction coefficient, and the second feeding portion 72 in which a static friction coefficient in the portion in contact with the medium 12 is a second static friction coefficient that is larger than the first static friction coefficient. The paddle 62 stops in a state which the second feeding portion 72 comes into contact with the medium 12 on the medium stacking portion 35 and is deformed. Therefore, the first feeding portion 71 feeds the medium 12 received by the medium stacking portion 35 with an appropriate frictional force at the time of alignment for feeding the medium 12 toward the medium butting portion 36, and when the paddle 62 is stopped, the medium 12 can be pressed by the second feeding portion 72 with a larger frictional force than by the first feeding portion 71. For example, the misalignment of the medium 12 to be discharged or the medium 12 to be transported in the first transport direction Y1 caused by the medium 12 coming into contact with the medium 12 of the medium stacking portion 35 can be suppressed.

(9) Each time the medium 12 is stacked in the medium stacking portion 35, the paddle 62 rotates once. The second feeding portion 72 contacts the medium 12 on the medium stacking portion 35 at the end of one rotation. Therefore, each time the medium 12 is stacked on the medium stacking portion 35, alignment and pressing of the medium 12 can be performed only by the rotational movement of the paddle 62.

(10) The stop position of the paddle 62 changes in accordance with the total thickness of the media 12 stacked in the medium stacking portion 35. Therefore, the medium 12 of the medium stacking portion 35 can be pressed with an appropriate holding force within a certain range regardless of the total thickness. When there is one medium 12 on the medium stacking portion 35, if the feeding force is too strong, there is a concern that the medium 12 hit the medium butting portion 36 too much and the alignment will be shifted, but there is no such concern. In addition, if the feeding portion 61 presses the medium 12 too hard, the feeding portion 61 is easily bent, but this kind of bending is less likely to occur. Furthermore, if the feeding portion 61 feeds the medium with too much strong pushing force, there is a concern that the printing surface will be damaged if the feeding portion 61 is rubbed, but there is no concern that this kind of printing surface will be damaged.

(11) As the total thickness of the media 12 stacked in the medium stacking portion 35 is thicker, the paddle 62 is stopped earlier. Therefore, the medium 12 of the medium stacking portion 35 can be pressed with an appropriate holding force within a certain range regardless of the total thickness.

(12) The medium processing device 28 includes the transport mechanism 30 that transports the medium 12 in the first transport direction Y1 and the second transport direction Y2, and the intermediate stacker 32. Thus, the medium processing device 28 can obtain the same effect as the intermediate stacker 32.

The above embodiment can also be changed to a form such as modification examples shown below. Furthermore, a combination of the above-described embodiment and the modification examples shown below as appropriate can be further used as a modification example, and a combination of the modification examples shown below as appropriate can be further used as a modification example.

Figure 18:
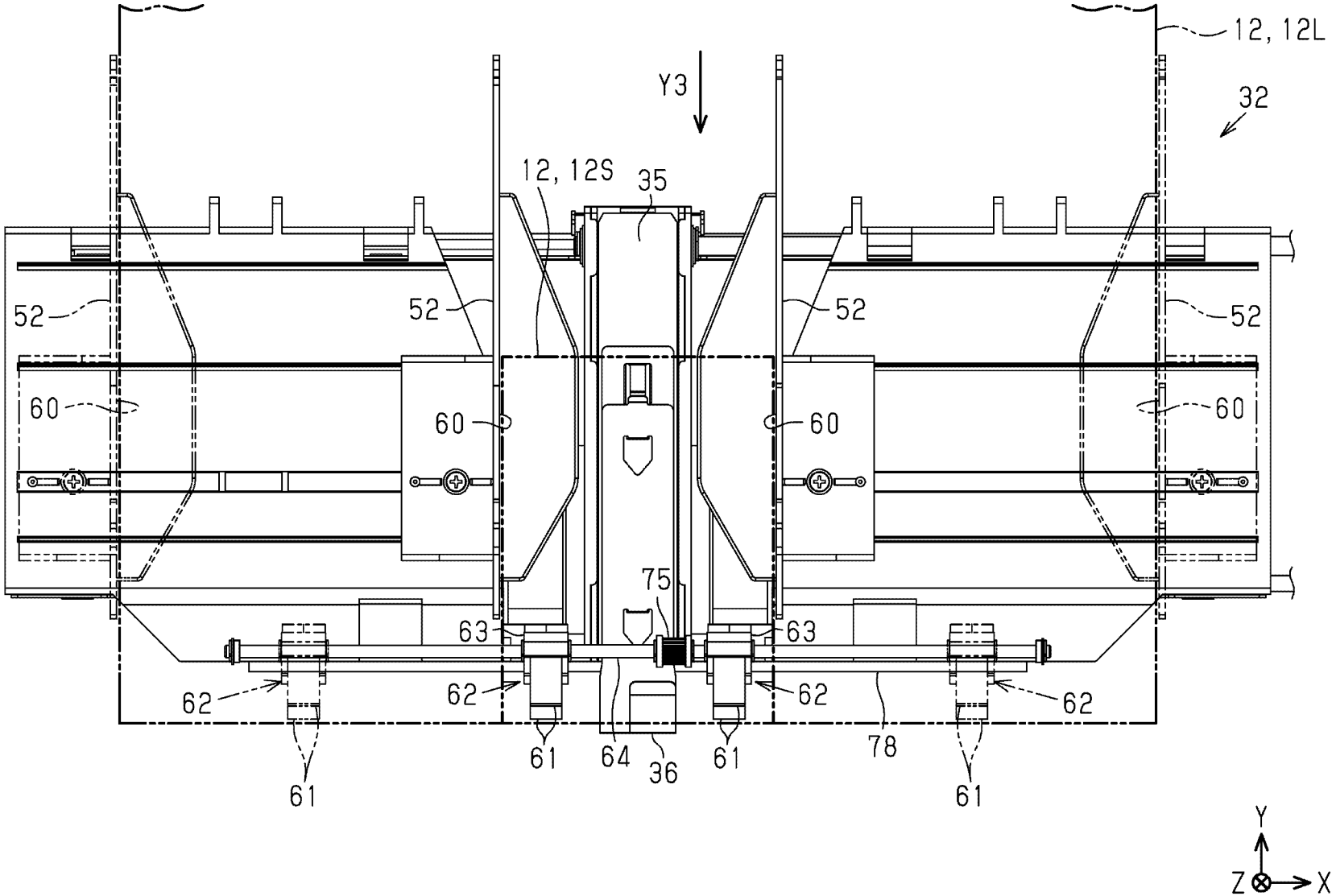
FIG. 18 is a plan view showing a stacker provided with paddles in a modification example.

The paddle 62 may be configured to be movable in the width direction X. For example, as shown in FIG. 18, the rotation shaft 64 rotatably supporting the pair of paddles 62 extends in the width direction X over a predetermined length, and the pair of paddles 62 are provided movably in the axial direction along the rotation shaft 64. The rotating member 63 of the paddle 62 is connected to be movable in the axial direction with respect to the rotation shaft 64 and to be integrally rotatable in the rotational direction, for example, by spline connection. Below the rotation shaft 64, a second movement mechanism 78 having an engaging portion movable in the width direction X is provided, and the engaging portion engages the rotating member 63 in a state in which the paddle 62 can rotate. The second movement mechanism 78 is driven by a drive source (not shown), has an engaging portion moving in the width direction X, and moves the paddle 62 in the width direction via the engaging portion. The pair of paddles 62 are moved to change the interval in the width direction X according to the width dimension of the medium 12. When the width of the medium 12 is narrow and the pair of alignment members 52 are disposed at the positions shown by the solid line in FIG. 18, the pair of paddles 62 are disposed at the narrowly spaced positions shown by the solid line in FIG. 18. On the other hand, when the width of the medium 12 is wide and the pair of alignment members 52 are disposed at the positions shown by the two-dot chain line in FIG. 18, the pair of paddles 62 are disposed at the widely spaced positions shown by the two-dot chain line in FIG. 18. The positions of the pair of paddles 62 are changed in the width direction X continuously or intermittently according to the width of the medium 12. For example, the control unit 80 acquires the width information of the medium 12 from a width sensor or job information, drives and controls the drive source of the second movement mechanism 78 based on the acquired width information, and controls the position of the pair of paddles 62 at a position corresponding to the width of the medium 12. For example, the width of the pair of paddles 62 may be changed in conjunction with the pair of alignment members 52. According to this configuration, it is possible to feed the medium 12 in contact with an appropriate position in the width direction X of the medium 12 by the pair of paddles 62. The pair of paddles 62 may be rotatably supported on a slider (not shown) movable in the width direction X along a guide axis (not shown) so that the interval in the width direction X may be changed.

Figure 19:
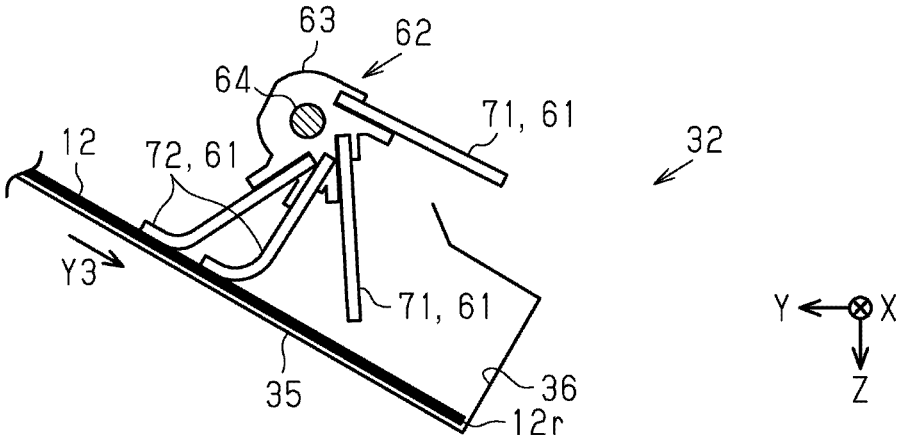
FIG. 19 is a partial side view showing a stacker provided with a paddle in a modification example different from FIG. 18.

The number of the feeding portions 61 that comes into contact with the medium 12 on the medium stacking portion 35 and is deformed when the paddle 62 is stopped may be plural. For example, as shown in FIG. 19, the paddle 62 may stop in a state in which a plurality of feeding portions 61 come into contact with the medium 12 on the medium stacking portion 35 and are deformed. According to this configuration, when the medium 12 is aligned, the feeding portion 61 sequentially contacts the medium 12 to feed the medium 12 in the butting direction Y3, and when the paddle 62 is stopped, the two feeding portions 61 come into contact with the medium 12 and are deformed. Therefore, when the paddle 62 is stopped, the feeding portion 61 can press the medium 12 with a strong frictional force. In this case, the plurality of feeding portions 61 may be only the first feeding portion 71 or may include the first feeding portion 71 and the second feeding portion 72. When feeding and aligning the medium 12, the first feeding portion 71 may contact the medium 12 to feed the medium 12 sequentially in the butting direction Y3, and when the paddle 62 is stopped, the medium 12 may be pressed by the two second feeding portions 72 or by combining the first feeding portion 71 and the second feeding portion 72. For example, when feeding the medium with an excessive pushing force at the time of alignment, due to the excessive frictional force between the medium 12 newly received in the medium stacking portion 35 and the medium 12 therebelow, there is a concern that it will be difficult to feed the medium 12 that is less likely to slip. On the other hand, according to the configuration shown in FIG. 19, at the time of alignment, since one feeding portion 61 feeds with an appropriate pressing force, the frictional force between the newly received medium 12 and the medium 12 therebelow does not become excessive and the medium 12 can slide relative to the medium 12 therebelow, the medium 12 can be reliably fed and aligned in the butting direction Y3. In addition, after alignment, since the paddle 62 stops in a state in which the plurality of feeding portions 61 come into contact with the medium 12 and are deformed, a large pressing force can be applied to the medium 12 to press the medium 12 with a large frictional force. The number of the feeding portions 61 when pressing the medium 12 is not limited to two and may be three or more.

Figure 20:
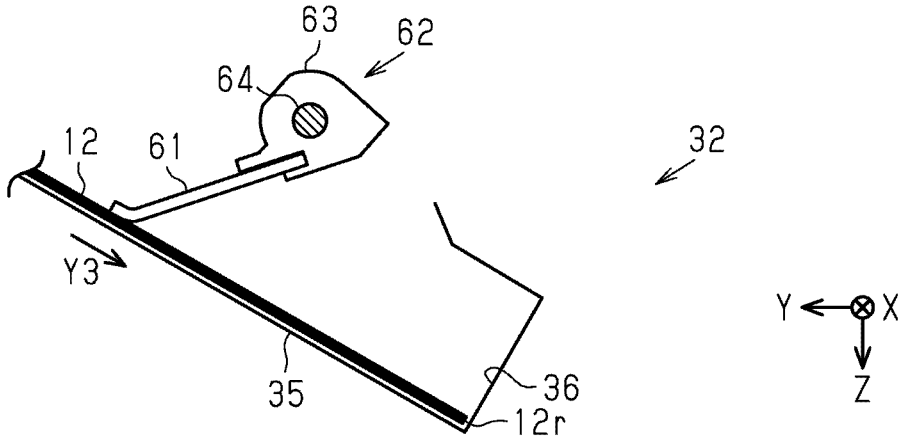
FIG. 20 is a partial side view showing a stacker provided with a paddle in a modification example different from FIG. 19.

The number of feeding portions 61 included in the paddle 62 may be one. For example, as shown in FIG. 20, the paddle 62 has only one feeding portion 61. In this configuration, the paddle 62 rotates a plurality of times in one feed operation, and one feeding portion 61 feeds the medium 12 on the medium stacking portion 35 once for each rotation of the paddle 62. Then, the paddle 62 stops in a state in which one feeding portion 61 comes into contact with the medium 12 and is deformed. Also according to this configuration, the paddle 62 is stopped in a state in which one feeding portion 61 comes into contact with the medium 12 and is deformed, and therefore, the shift of the medium 12 when discharged and the subsequent medium 12 when transported in the first transport direction Y1, which is caused by the medium 12 coming into contact with the medium 12 on the medium stacking portion 35, can be suppressed. Thus, the medium 12 on the medium stacking portion 35 can be held in alignment.

The difference between the first static friction coefficient and the second static friction coefficient may be realized by changing the form of the portion of the first feeding portion 71 and the second feeding portion 72 in contact with the medium 12. For example, the surface of the first feeding portion 71 in contact with the medium 12 may be a smooth surface, and the surface of the second feeding portion 72 in contact with the medium 12 may be an uneven surface.

The intermediate device 15 may not be provided in the medium processing system 11. That is, the medium processing system 11 may be configured with the printing device 13 and the post-processing device 14. In this case, the function of the intermediate device 15 may be incorporated into the post-processing device 14. The post-processing device 14 may reverse the medium 12 carried in from the printing device 13 and then receive the medium 12 in the intermediate stacker 32 to perform post-processing.

The medium stacking portion 35 is not limited to being provided in the post-processing device 14. The printing device 13 may be configured to include the medium processing device 28. In a case where the material of the feeding portion 61 is rubber or elastomer, the material of the reinforcing sheet used for reinforcement is not limited to PET, but may be a sheet of a known synthetic resin such as ABS resin, polyamide, PBT, polyethylene, polyimide, polypropylene, phenol resin, polystyrene, polyurethane, PVC, and the like. In addition, the feeding portion 61 may be a sheet made of a composite or a laminate of a plurality of synthetic resins. In particular, a sheet made of these composites or laminates may be used for the second feeding portion 72.

The processing unit is not limited to the recording head 25 that performs the printing processing in the printing device 13. For example, a processing unit that performs coating processing on the medium 12, a processing unit that performs heat treatment on the medium 12, and a processing unit that performs photo-setting treatment on the photocurable resin attached to the medium 12 may be used.

The transport mechanism 30 is not limited to the belt transport method. The transport mechanism 30 may be a roller transport system in which the medium 12 is transported by one or more pairs of rollers. The transport direction when the transport mechanism 30 causes the medium 12 to be received on the medium stacking portion 35 is not limited to the second transport direction Y2 in which the medium 12 is transported after the switchback and may be the first transport direction Y1. That is, the medium 12 may be received in the medium stacking portion 35 in the process of being discharged in the first transport direction Y1 without the switchback by the transport mechanism 30. Also in these transport mechanisms 30, since the medium 12 on the medium stacking portion 35 can be held with a large frictional force by the one or more feeding portions 61 being deformed and brought into contact with the medium 12 when the paddle 62 stops, it is possible to suppress the misalignment of the medium caused by the medium 12 discharged in the first transport direction Y1 contacting the medium 12 on the medium stacking portion 35.

The lengths of the plurality of feeding portions 61 included in the paddle 62 may be different. The number of rotations of the paddle 62 including the plurality of feeding portions 61 each time the medium 12 is received by the medium stacking portion 35 is not limited to one rotation and may be a plurality of rotations.

The intervals in the rotational direction of the plurality of feeding portions included in the paddle 62 may be different. The rotation of the paddle 62 is not limited to one rotation or more and may be less than one rotation. For example, the paddle 62 may be rotated half.

The static friction coefficients of the first feeding portion 71 and the second feeding portion 72 with respect to the medium 12 may be the same. In addition, the static friction coefficient of the first feeding portion 71 may be larger than the static friction coefficient of the second feeding portion 72.

The number of feeding portions 61 included in the paddle 62 may be plural other than three. The stop position of the paddle 62 may be changed according to the thickness and the material of the medium 12. For example, in the case of the thin medium 12, the timing of stopping the paddle 62 is delayed so that the force to press the medium 12 becomes stronger than in the case of the thick medium 12. This is because the thin medium 12 tends to curl, and when the medium is discharged or transported in the first transport direction Y1, the sliding resistance when the medium contacts the medium 12 of the medium stacking portion 35 tends to increase. In addition, for example, in the case of the medium 12 having a large static friction coefficient, the timing at which the paddle 62 is stopped is delayed so that the force pressing the medium 12 is stronger than in the case of the medium 12 having a small static friction coefficient. Here, as an example of the medium 12 having a large static friction coefficient, the medium 12 with a small thickness, which has a high penetration rate at which the liquid discharged and landed from the recording head 25 penetrates, may be mentioned. In addition, examples of the medium 12 having a large static friction coefficient include the medium 12 having a large amount per unit area of the liquid discharged and landed from the recording head 25 even if the medium has the same thickness.

It is desirable that the paddles 62 be provided inside both ends in the width direction X of the medium 12 having the smallest width among the media 12 that can be handled by the medium processing device 28. In this case, one paddle 62 may be provided. In addition, the paddles 62 may be provided outside both ends in the width direction X of the medium 12 having the smallest width among the media 12 that can be handled by the medium processing device 28. For example, a configuration may be adopted in which the pair of paddles 62 shown by the solid line in FIG. 18 and the pair of paddles 62 shown by the two-dot chain line are fixed together. Thus, one or more pairs of paddles 62 may be provided outside the pair of paddles 62 in the width direction X. According to this configuration, it is possible to press the large-sized medium 12 with more paddles 62 with appropriate strength.

The medium is not limited to paper and may be a synthetic resin film or sheet, cloth, non-woven fabric, laminate sheet or the like. The printing device 13 may be a multifunction peripheral having a scanner mechanism and a copying function in addition to the printing function.

The printing device 13 is not limited to a liquid discharge system such as an ink jet system and may be a dot impact system or an electrophotographic system. In addition, the printing device 13 may be a textile printing device. Hereinafter, technical ideas grasped from the above-described embodiment and modification examples will be described with an effect.

Idea 1

A stacker includes a medium stacking portion for receiving and stacking a medium processed and discharged by a processing unit, a medium butting portion for aligning the medium by contacting the leading end of the medium, and a paddle that includes a feeding portion and is for transporting the medium received by the medium stacking portion in a direction toward the medium butting portion by rotating, and having a first mode in which the paddle stops in a state in which the feeding portion does not contact the medium on the medium stacking portion, and a second mode in which the paddle stops in a state in which the feeding portion comes into contact with the medium on the medium stacking portion and is deformed.

According to this configuration, the medium received by the medium stacking portion can be fed by the feeding portion, and the medium can be aligned on the medium stacking portion when the medium abuts against the medium butting portion, and the media can be held by applying a pressing force on the media by the feeding portion that contacts the media aligned on the medium stacking portion while the paddle is stopped until the next media is received in the medium stacking portion after the alignment.

Idea 2

In the stacker described in Idea 1, when one medium is discharged, the paddle stops in a state in which the feeding portion comes into contact with the medium on the medium stacking portion and is deformed.

According to this configuration, the feeding portion comes into contact with the medium aligned on the medium stacking portion and is deformed while the paddle is stopped until the next medium is received by the medium stacking portion after the alignment, thereby holding the medium by applying the pressing force to the medium. For example, when one medium is discharged in the first transport direction, misalignment of the medium on the medium stacking portion caused by the medium coming into contact with the medium aligned on the medium stacking portion can be suppressed.

Idea 3

A stacker includes a medium stacking portion for receiving and stacking a medium transported in a second transport direction which is a direction opposite to a first transport direction after being transported in the first transport direction, a medium butting portion for aligning the medium by contacting a leading end of the medium, and a paddle that includes a feeding portion and is for transporting the medium received by the medium stacking portion of the medium butting portion by rotating, and has a first mode in which the paddle stops in a state in which the feeding portion does not contact the medium on the medium stacking portion, and a second mode in which the paddle stops in a state in which the feeding portion comes into contact with the medium on the medium stacking portion and is deformed.

According to this configuration, the medium received by the medium stacking portion can be fed by the feeding portion, and the medium can be aligned on the medium stacking portion when the medium abuts against the medium butting portion, and the media can be held by applying a pressing force on the media by the feeding portion that contacts the media aligned on the medium stacking portion while the paddle is stopped until the next media is received in the medium stacking portion after the alignment.

Idea 4

In the stacker described in Idea 3, when one medium is transported in the first transport direction, the paddle stops in a state in which the feeding portion comes into contact with the medium on the medium stacking portion and is deformed.

According to this configuration, the feeding portion comes into contact with the medium aligned on the medium stacking portion and is deformed while the paddle is stopped until the next medium is received by the medium stacking portion after the alignment, thereby holding the medium by applying the pressing force to the medium. For example, when one medium is transported in the first transport direction, it is possible to suppress the misalignment of the media on the medium stacking portion caused by the media coming into contact with the medium aligned on the medium stacking portion.

Idea 5

In the stacker described in Idea 4, it is preferable that the paddle resume to rotate as the transport direction of the one medium is switched from the first transport direction to the second transport direction.

According to this configuration, the media received by the medium stacking portion can be aligned by feeding the media to be received by the medium stacking portion and transported in the second transport direction, in the direction of the media butting portion by the feeding portion of the rotating paddle.

Idea 6

In the stacker described in any one of Idea 1 to Idea 5, it is preferable that the feeding portion include a first feeding portion having a first bending rigidity, and a second feeding portion having a second bending rigidity higher than the first bending rigidity and the paddle stop in a state in which the second feeding portion comes into contact with the medium on the medium stacking portion.

According to this configuration, it is possible to press the medium on the medium stacking portion with a strong frictional force. Here, the frictional force is represented by a static friction coefficient x a vertical drag. By stopping the paddle in a state in which the second feeding portion having the second bending rigidity comes into contact with the medium and is deformed, compared to the case of stopping the paddle in a state in which the first feeding portion having the first bending rigidity comes into contact with the medium and is deformed, a larger vertical drag can be generated. Therefore, the medium on the medium stacking portion can be pressed by the second feeding portion with a strong frictional force.

Idea 7

In the stacker described in Idea 6, the static friction coefficient of the portion of the second feeding portion in contact with the medium may be larger than the static friction coefficient of the portion of the first feeding portion in contact with the medium.

According to this configuration, it is possible to press the medium of the medium stacking portion with a strong frictional force. For example, the misalignment of the medium due to the contact of the medium to be discharged or the medium to be transported in the first transport direction can be suppressed. Here, the frictional force is represented by a static friction coefficient x a vertical drag, and by stopping the paddle in a state in which the second feeding portion having both a static friction coefficient and a vertical drag larger than those of the first feeding portion, comes into contact with the medium and is deformed, compared to the case of stopping the paddle in a state in which the first feeding portion comes into contact with the medium and is deformed, the medium on the medium stacking portion can be pressed with a stronger frictional force.

Idea 8

In the stacker described in any one of Idea 1 to Idea 5, it is preferable that the feeding portion include a first feeding portion in which a static friction coefficient in the portion in contact with the medium is a first static friction coefficient, and a second feeding portion in which a static friction coefficient in the portion in contact with the medium is a second static friction coefficient that is larger than the first static friction coefficient and the paddle stop in a state in which the second feeding portion comes into contact with the medium on the medium stacking portion and is deformed.

According to this configuration, the first feeding portion feeds the medium received by the medium stacking portion with an appropriate frictional force at the time of feeding and aligning the medium toward the medium butting portion, and when the paddle is stopped, the second feeding portion can press the medium with a larger frictional force than the first feeding portion. For example, the misalignment of the medium to be discharged or the medium to be transported in the first transport direction caused by the medium coming into contact with the medium of the medium stacking portion can be suppressed.

Idea 9

In the stacker according to any one of Idea 6 to Idea 8, it is preferable that the paddle perform one rotation operation each time the medium is stacked on the medium stacking portion and the second feeding portion contact the medium on the medium stacking portion at the end of the one rotation operation.

Idea 10

According to this configuration, each time the medium is stacked on the medium stacking portion, alignment and pressing of the medium can be performed only by the rotational movement of the paddle. In the stacker described in any one of Idea 1 to Idea 9, it is preferable that the stop position of the paddle change according to the total thickness of the media stacked in the medium stacking portion.

Idea 11

According to this configuration, the medium of the medium stacking portion can be pressed with an appropriate frictional force within a certain range. In the stacker described in Idea 10, it is preferable that the paddle stop earlier as the total thickness of the media stacked on the medium stacking portion is larger.

Idea 12

According to this configuration, the medium of the medium stacking portion can be pressed with an appropriate frictional force within a more constant range. In the stacker described in any one of Idea 1 to Idea 11, when the paddle is stopped, it is preferable that the paddle stop in a state in which the plurality of feeding portions come into contact with the medium on the medium stacking portion and are deformed.

According to this configuration, at the time of aligning the medium, the medium can be fed while being pressed with an appropriate strength without being excessively pressed, and at the time of pressing the medium, the medium can be pressed by a strong frictional force.

Idea 13

The medium processing device includes the stacker described in any one of Idea 1, Idea 2, and Idea 6 to Idea 12, and a transport mechanism that transports the medium and discharging the medium to the stacker.

According to this configuration, even in the medium processing device, the same effect as the above-described stacker can be obtained.

The medium processing device includes the stacker described in any one of Idea 3 to Idea 12, and a transport mechanism for transporting the medium in a first transport direction and a second transport direction opposite to the first transport direction and discharging the medium to the stacker.

According to this configuration, even in the medium processing device, the same effect as the above-described stacker can be obtained.

What is claimed is:

1. A stacker comprising:

a medium stacking portion receiving and stacking a medium processed and discharged by a processing unit;

a medium butting portion aligning the medium by contacting a leading end of the medium;

a paddle including a feeding portion and being for transporting the medium received by the medium stacking portion in a direction toward the medium butting portion by rotating, wherein the stacker has a first mode that makes the medium on the medium stacking portion moveable and a second mode that prevents the medium on the medium stacking portion from sliding, in the first mode, the paddle stops in a state in which the feeding portion does not contact the medium on the medium stacking portion, in the second mode, the paddle stops in a state in which the feeding portion comes into contact with the medium on the medium stacking portion and is deformed, and when one medium is discharged, the paddle stops in the second mode, wherein the feeding portion includes a first feeding portion and a second feeding portion having a friction force with the medium that is different from that of the first feeding portion, the first feeding portion having a first bending rigidity, the second feeding portion having a second bending rigidity higher than the first bending rigidity, the paddle stops in a state in which the second feeding portion comes into contact with the medium on the medium stacking portion, a static friction coefficient of a portion of the second feeding portion in contact with the medium is larger than a static friction coefficient of a portion of the first feeding portion in contact with the medium, the feeding portion of one paddle includes the first feeding portion and a plurality of second feeding portions whose friction force with the medium is different from that of the first feeding portion, and the paddle stops in a state in which a plurality of feeding portions come into contact with the medium on the medium stacking portion and are deformed.

2. The stacker according to claim 1, wherein the paddle performs one rotation operation each time the medium is stacked on the medium stacking portion, and the second feeding portion contacts the medium on the medium stacking portion at the end of the one rotation operation.

3. The stacker according to claim 1, wherein a stop position of the paddle changes according to a total thickness of the media stacked in the medium stacking portion.

4. The stacker according to claim 3, wherein the paddle stops earlier as the total thickness of the media stacked on the medium stacking portion is thicker.

5. A medium processing device comprising:

the stacker according to claim 1; and a transport mechanism transporting the medium and discharging the medium to the stacker.

6. The stacker according to claim 1, wherein the stacker as a plurality of paddles.

7. A stacker comprising:

a medium stacking portion receiving and stacking a medium transported in a second transport direction which is a direction opposite to a first transport direction after being transported in the first transport direction;

a medium butting portion aligning the medium by contacting a leading end of the medium; and a paddle including a feeding portion and being for transporting the medium received by the medium stacking portion toward the medium butting portion by rotating, wherein the stacker has a first mode that makes the medium on the medium stacking portion moveable and a second mode that prevents the medium on the medium stacking portion from sliding, in the first mode, the paddle stops in a state in which the feeding portion does not contact the medium on the medium stacking portion, in the second mode, the paddle stops in a state in which the feeding portion comes into contact with the medium on the medium stacking portion and is deformed, and when one medium is discharged, the paddle stops in the second mode, wherein the feeding portion includes a first feeding portion and a second feeding portion having a friction force with the medium that is different from that of the first feeding portion, the first feeding portion having a first bending rigidity, the second feeding portion having a second bending rigidity higher than the first bending rigidity, the paddle stops in a state in which the second feeding portion comes into contact with the medium on the medium stacking portion, a static friction coefficient of a portion of the second feeding portion in contact with the medium is larger than a static friction coefficient of a portion of the first feeding portion in contact with the medium, the feeding portion of one paddle includes the first feeding portion and a plurality of second feeding portions whose friction force with the medium is different from that of the first feeding portion, and the paddle stops in a state in which a plurality of feeding portions come into contact with the medium on the medium stacking portion and are deformed.

8. The stacker according to claim 7, wherein the paddle resumes to rotate as the transport direction of the one medium is switched from the first transport direction to the second transport direction.

9. A medium processing device comprising:

the stacker according to claim 7; and a transport mechanism transporting the medium in a first transport direction and a second transport direction opposite to the first transport direction and discharging the medium to the stacker.

* * * * *